US005486150A

United States Patent [19]

Randolph

[11] Patent Number: 5,486,150

[45] Date of Patent: Jan. 23, 1996

[54] EXERCISE SYSTEM, APPARATUS AND METHOD

[76] Inventor: Lucian Randolph, 11456 Peachstone La., Orlando, Fla. 32821-7971

[21] Appl. No.: 56,845

[22] Filed: Apr. 30, 1993

[51] Int. Cl.[6] ..... A63B 21/02; A63B 23/035

[52] U.S. Cl. ..... 482/133; 482/123; 482/130; 482/137

[58] Field of Search ..... 482/100, 101, 482/121, 123, 124, 126, 129, 130, 133–139, 908, 112

[56] References Cited

U.S. PATENT DOCUMENTS

| | | | |
|---|---|---|---|
| 177,251 | 5/1876 | Johnson | 482/112 |
| 181,424 | 8/1876 | Evarts | 482/123 |
| 3,359,802 | 12/1967 | Sollenberger | 482/112 |
| 3,985,354 | 10/1976 | Schulkin | 482/123 |
| 4,072,309 | 2/1978 | Wilson . | |
| 4,235,437 | 11/1980 | Ruis et al. | 482/137 |
| 4,502,681 | 3/1985 | Blomqvist . | |
| 4,521,013 | 6/1985 | Dofel . | |
| 4,537,395 | 8/1985 | Spinelli . | |
| 4,576,377 | 3/1986 | Wolff . | |
| 4,582,320 | 4/1986 | Shaw . | |
| 4,618,144 | 10/1986 | Gibson . | |
| 4,623,267 | 11/1986 | White . | |
| 4,627,614 | 12/1986 | Angeli . | |
| 4,638,995 | 1/1987 | Wilson . | |
| 4,651,719 | 3/1987 | Funk et al. | 482/901 |
| 4,684,125 | 8/1987 | Lantz | 482/908 |
| 4,691,918 | 9/1987 | Rockwell . | |
| 4,746,115 | 5/1988 | Lahman | 482/113 |
| 4,772,015 | 9/1988 | Carlson et al. | 482/908 |
| 4,817,943 | 4/1989 | Pipasik . | |
| 4,826,157 | 5/1989 | Fitzpatrick . | |
| 4,861,022 | 8/1989 | Boatcallie | 482/126 |
| 4,898,381 | 2/1990 | Gordon | 482/908 |
| 4,907,798 | 3/1990 | Burchatz . | |
| 4,919,419 | 4/1990 | Houston . | |
| 4,951,942 | 8/1990 | Walden . | |
| 5,215,511 | 6/1993 | Cheng | 482/133 |
| 5,250,015 | 10/1993 | Thornton | 482/112 |
| 5,299,998 | 4/1994 | Hutchins | 482/135 |

FOREIGN PATENT DOCUMENTS

| | | | |
|---|---|---|---|
| 2223686 | 4/1990 | United Kingdom | 482/137 |

*Primary Examiner*—Richard J. Apley
*Assistant Examiner*—Jeanne M. Clark
*Attorney, Agent, or Firm*—Allen, Dyer, Doppelt, Franjola & Milbrath

[57] ABSTRACT

An exercise frame includes an upstanding back rest and an intersecting seat, with a pair of exercise arm assemblies supported along corresponding sides of the back rest and exercise leg assemblies supported along corresponding sides of the seat. Each arm and leg assembly is segmented and linked together so as to limit and restrict movement of the distal ends of each arm or leg assembly along a straight line passing through the corresponding proximal and distal ends.

37 Claims, 13 Drawing Sheets

EXERCISE SYSTEM, APPARATUS AND METHOD

BACKGROUND

The present invention relates to exercise equipment and methods.

In general, exercise can be organized into two principal categories, cardiovascular and musculoskeletal. Cardiovascular exercises, such as aerobics, are quite popular. However, it is now known that cardiovascular training alone is not sufficient to obtain balanced fitness, and there is growing evidence identifying a clear need to provide for muscular and joint strength in addition to cardiovascular health.

Muscular development falls into four general types. One type is isometric contraction, which results in an increase of muscle tension while the muscle length remains constant. Typical examples of isometric muscular activity includes the flexing of the arm or pushing the hands together while the arm or hands are not moved through a range of motion. While the tension increases in the muscle, the muscle does not move.

The second type of muscle development is known as pleiometric contraction, which occurs when both the muscle tension and length increases. This type of contraction occurs in exercises such as walking down stairs or landing from a jump.

A third type of muscle activity is known as isotonic contraction, in which the muscle tension remains constant and the muscle length decreases; such muscle activity occurs in the legs during walking or running.

A fourth type of muscle activity is known as isokinetic contraction, and occurs when the muscle tension increases and the muscle length decreases. Conventional weight lifting is an example of this type of activity.

It is generally known that the best way to develop the shape, size and definition of muscles is to apply a resistance and then move the muscle through its entire range of motion from a full stretch to a full contraction and back to a full stretch (or vice versa). It is also known that to improve the strength of the bones and joints, it is necessary to move the joints through its correct plane of movement; movement through an incorrect plane may actually weaken or injure a joint, or fracture a bone.

In addition to so called "free weights" (i.e., barbells and the like) there have been developed a number of exercise machines which assist an individual in achieving isokinetic muscle exercise. These prior art machines are based on a variety of lever arm and other mechanical techniques. Some of these prior art systems have been developed to provide multiple purpose exercises for a variety of different muscles. Examples of such equipment are disclosed in the following U.S. Pat. Nos.: 4,951,942 to Walden; 4,919,419 to Houston; 4,907,798 to Burchatz; 4,826,157 to Fitzpatrick; 4,691,918 to Rockwell; 4,638,995 to Wilson; 4,627,614 to diAngeli; 4,618,144 to Gibson; 4,582,320 to Shaw; 4,576,377 to Wolff; 4,521,013 to Dofel, and 4,072,309 to Wilson. There is also disclosed in U.S. Pat. No. 4,623,267 an elastomeric bearing system for use in multiple purpose exercise apparatus, particularly of the type disclosed in U.S. Pat. No. 4,072,309 to Wilson, which is sold under the SOLOFLEX trademark. Recently, Nordictrack of Chaska, Minn. introduced an exercise system under the trademark NORDIC-FLEX GOLD, which system uses a straight rail and a lever arm to direct an exercise along a restricted plane.

The manner of operation of a typical lever-type prior art multiple purpose exercise system is illustrated in FIGS. 1 and 2. In one exercise known as the "bench press" shown in FIG. 1, the person exercising (designated by the letters "EP") rests upon a horizontal seat and maneuvers a lever L1 through an arc A1. With the lever under tension (for example, by the use of elastic bands as disclosed by Wilson in the aforementioned U.S. Pat. No. 4,072,309), isokinetic muscle contraction is achieved. However, because the arc A1 is displaced across the body of the exercising person EP, then different portions of the same muscle group are being utilized during the same exercise. Similarly, in using the equipment of FIG. 1 in an overhead exercise (as shown in FIG. 2), the exercising person, while operating the lever L2 under tension, is required to extend the lever L2 through an arc A2, thus also displacing the direction of exercise laterally and thereby using different muscle groups.

In U.S. Pat. No. 4,817,943, Pipasik discloses a total shoulder exercise and muscle development machine in which each forearm is placed against an arm abutment member, and then the forearms are rotated outwardly while the hands are also used to develop the shoulder by extension of a hand grip mechanism along a straight line into a spring biased cylinder.

SUMMARY OF THE INVENTION

Among the purposes of the present invention is to provide a system, apparatus and related methods which permit the exercising of a selected muscle of an individual only along a straight line which lies in a plane passing through the muscle and the proximal and distal extremities of the limb of the individual which is being exercised. In a preferred embodiment, this is achieved by providing an exercise frame and an arm assembly having a proximal end coupled to the frame and with the arm assembly also having a distal end. Means are provided for limiting movement of the distal end of the arm along a straight line which passes through both the proximal and distal ends, with means also provided for applying an exercise resistance to movement of the arm assembly along the straight line. The exercise resistance may be applied to either a movement of the distal end away from or toward the proximal end. Means are also provided for changing the direction of the straight line from the proximal end.

In one form, the exercise arm assembly comprises first and second arm segments, with one end of the first arm segment comprising the proximal end and one end of the second arm segment comprising the distal end, with the first and second arm segments being coupled together at a pivot or equivalent mechanical means at a point intermediate between the proximal and distal ends. The straight line limiting means comprises, in one example, a positive linkage between the first and second segments in order to force simultaneous movement of the intermediate point as the distal end is moved along the straight line. In one specific arrangement, the positive linking means comprises a first sprocket rotatably supported by the first arm segment and a second sprocket fixed to the second arm segment at the pivot with a positive linkage belt engaging the first and second sprockets for rotation together. Suitably, the first sprocket has a diameter which is twice that of the second sprocket in order to achieve the desired straight line movement.

In the preferred arrangement, the first and second arm segments lie in an arm plane and means are provided for changing the angular relationship of the arm plane with respect to the frame. Such means in one form includes a shoulder bracket rotatably attached between the frame and the proximal end of the arm assembly. A shoulder rod is coupled between the frame and the shoulder bracket, and provides means to change the direction of the straight line relative to the frame.

Also in the preferred embodiment, the system of the present invention has the capability to exercise different muscles and for limiting a single exercise to a single plane for a selected muscle. In particular, the system comprises an exercise frame including an upstanding back rest and a seat extending generally lateral from the back rest. A pair of exercise arm assemblies are supported along respective sides of the back rest and have a proximal end adjacent the back rest and a distal end extending away from the proximal end with a hand grip at the distal end. The system further includes a pair of exercise leg assemblies each supported along one side of the seat and having a proximal end adjacent the seat-back rest intersection and a distal end for engaging the leg or foot of the individual undertaking the exercise. Each of the arm and leg assemblies include means for restricting movement of the distal end to a straight line passing through both the distal and proximal ends, and which straight line lies in a plane which passes through the muscle being exercised. Means are also provided for applying an exercise resistance to movement of the exercise arm assembly along the straight line, and for changing the angular relationship of each arm assembly with respect to the back rest, as well as the angular relationship between the seat and each leg assembly.

In use, the exercise system restricts movement of the distal end of the arm assembly along a line lying in a first plane passing through the selected muscle being exercised as well as the proximal and distal ends of the respective arm or leg assembly, while applying a resistance to the movement of the distal end across that first plane. The arm or leg assembly is then rotated to another position and thereafter movement of the distal end is restricted along a straight line lying in a second plane which also passes through the selected muscle as well as the proximal and distal ends of the respective arm or leg assembly. This procedure may be continued for several different planes through the same muscle. In this way, the system and apparatus of the present invention permits a person exercising to achieve a linear resistance which is restricted along a specific line or plane which passes through the particular muscle group being exercised, thus permitting the muscle being exercised to be carefully controlled. Further, the exercise system and apparatus permits the same muscle group to be exercised along different planes passing through that same muscle group, thereby achieving a more specific strengthening of that muscle group, as desired.

Other details and features of this invention will be understood from a review of the detailed description and drawings, discussed below.

THE DRAWINGS

Figure 1:
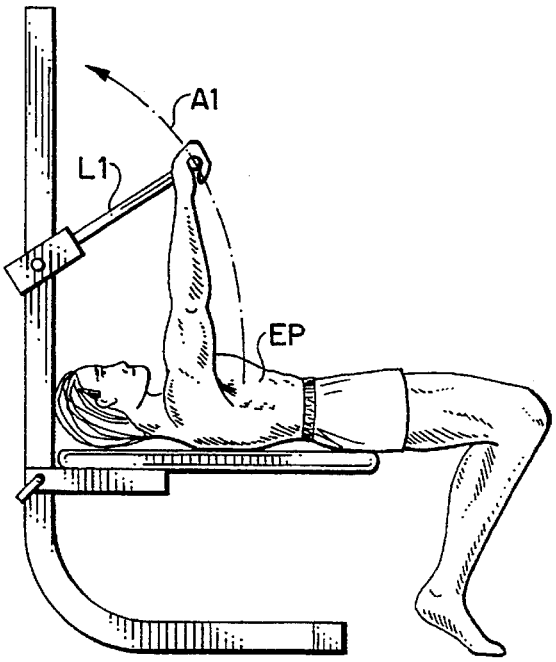
FIG. 1 (PRIOR ART)
FIGS. 1 and 2 are side views illustrating one prior art exercise system and the method of exercising using the system.
Figure 2:
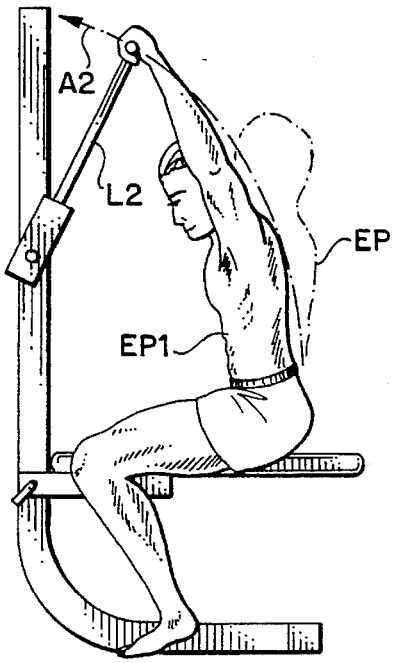
FIG. 2 (PRIOR ART)

In FIGS. 3–32, two-digit reference numerals are used to identify major components, and three-digit reference numerals are used to identify specific features of a major component having a corresponding designation represented by the first two digits of the three-digit number (for example, in FIGS. 3–7, reference numeral 28 refers to a shoulder assembly, while reference numeral 282 refers to the indexing plates which form a part of the shoulder assembly 28).

DETAILED DESCRIPTION OF THE PREFERRED EMBODIMENT

The major components of the exercise system 10 will be first described with reference to FIGS. 3 and 4, which is then followed by a detailed description of each major component as illustrated in FIGS. 5–32.

Figure 4:
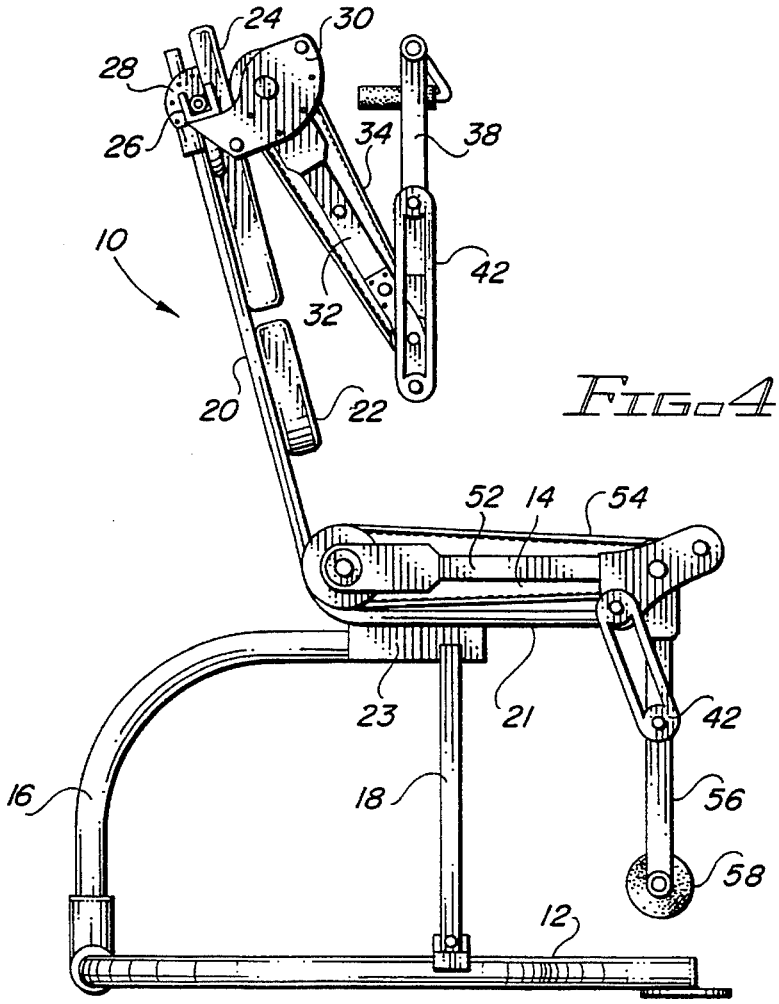
FIGS. 3 and 4 are perspective and side views, respectively, illustrating the major components of an exercise system and apparatus according to the present invention.
Figure 3:
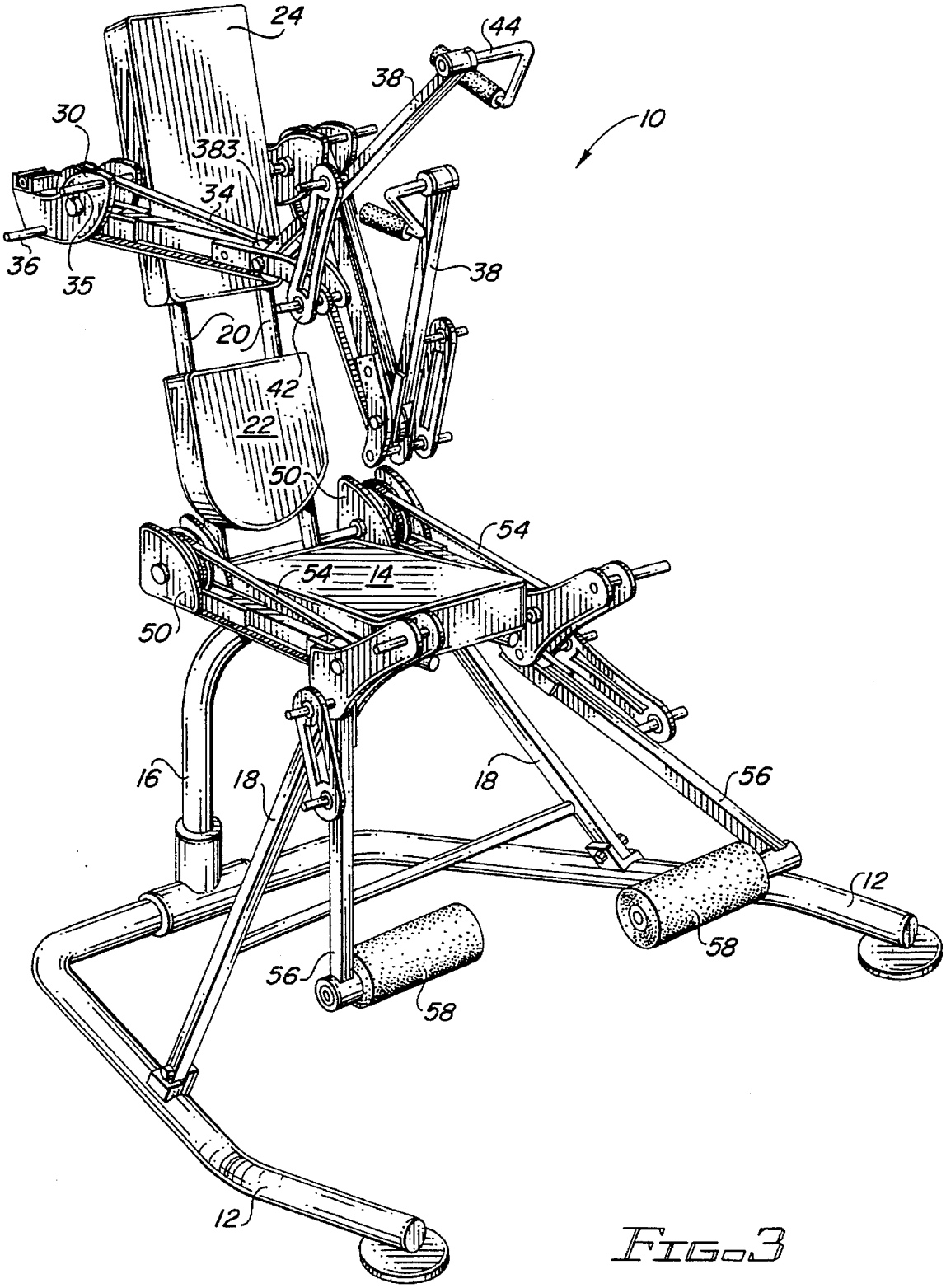
Figure 5:
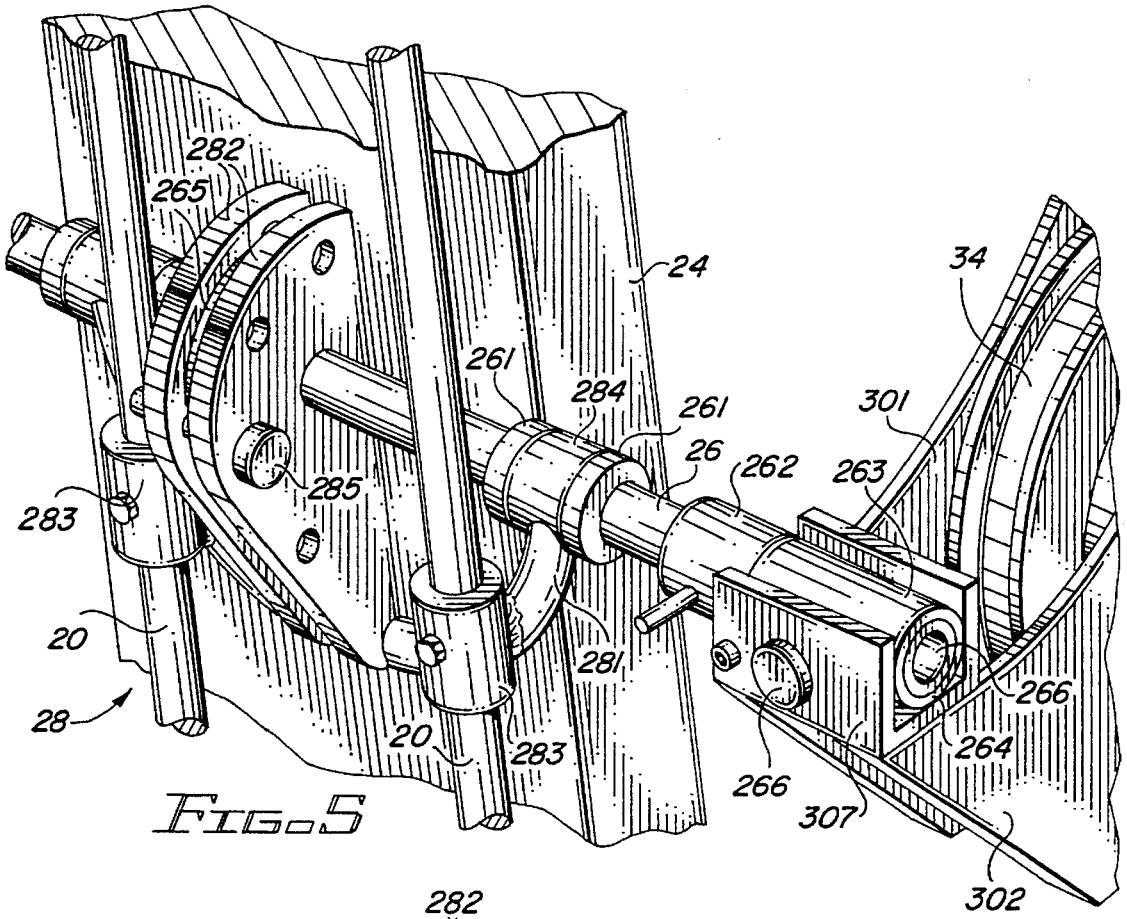
FIGS. 5–8 are perspective, top, front and side views, respectively, illustrating the rotatable shoulder support component of the system and apparatus of the present invention.
Figure 6:
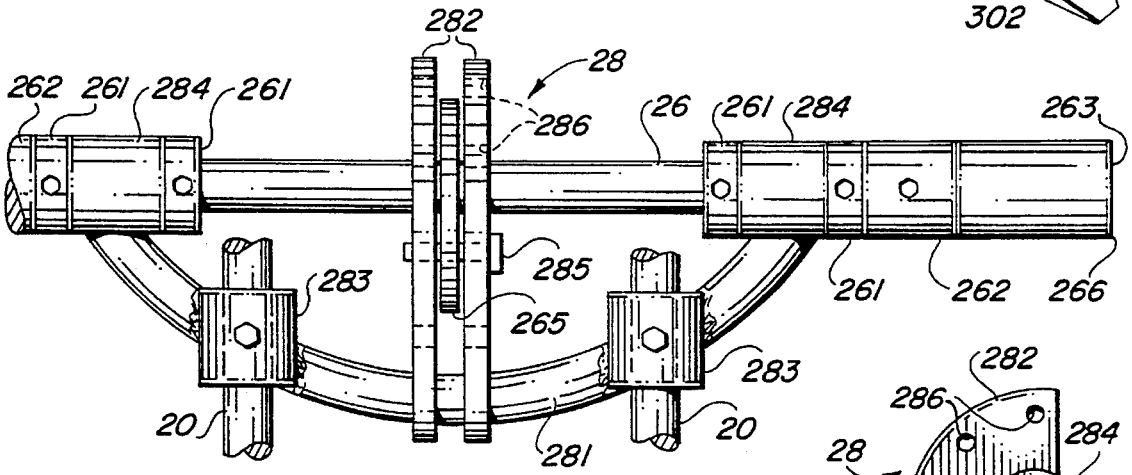
Figure 7:
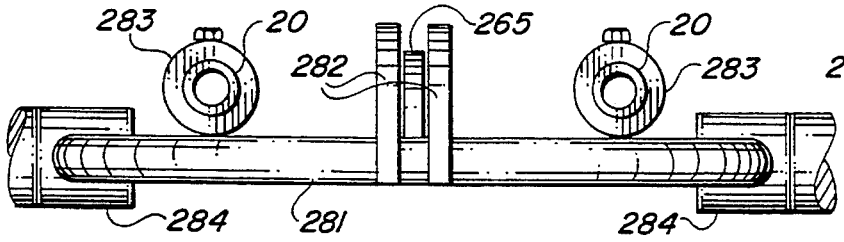
Figure 8:
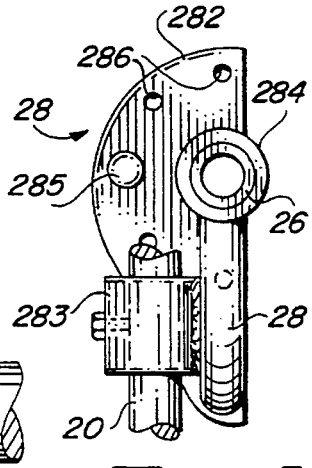
Figure 9:
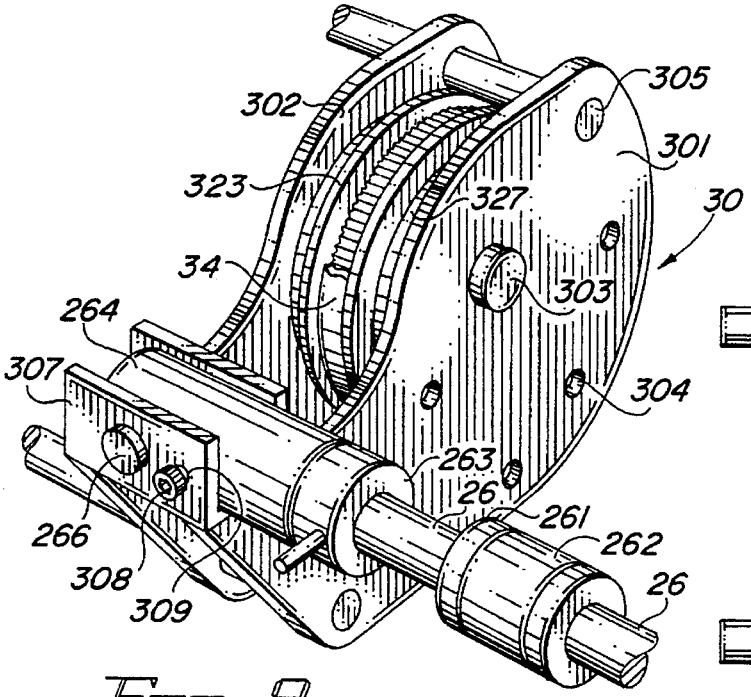
FIGS. 9 and 10 are perspective views.

Turning now to FIGS. 3 and 4, the exercise system 10 of the present invention includes base supports 12, a seat 14, a back stanchion 16 and struts 18 extending between the base supports 12 and the seat 14. The stanchion 16 and struts 18 extend to a lower frame support 23, upon which rests horizontal supports 20, which in turn support the seat 14. The horizontal supports 21 are integrally formed with vertical supports 20 to which are attached a lumbar pad 22 and a back rest 24. A shoulder rod 26 is mounted through indexing plates 28 to the vertical structural supports 20. The particular form of construction of the shoulder rod, index plates and attachment with the vertical supports 20 is described in greater detail below with reference to FIGS. 5–8.

With continuing reference to FIGS. 3 and 4, the exercise system be further includes a pair of shoulder brackets 30 each of which are mounted on the respective right and left extremities of the shoulder rod 26. Construction details of the shoulder bracket 30 are described below with reference to FIGS. 9–13.

In accordance with the present invention, the exercise system be is provided with a pair of exercise arm assemblies, each of which is attached to one of the shoulder brackets 30 along one side of the frame, including the vertical supports 20 and the back rest 24. Generally, each exercise arm assembly includes a first arm segment 32, a second arm segment 38 and an interconnecting positive linkage belt 34 between the first and second arm assembly segments. In order to provide the desired exercise tension, an elastomeric member 42 is attached between selected points on the first and second arm segments 32, 38. A hand grip assembly 44 is attached at the outer extremity of the second arm segment 38. The construction details for the arm assembly are set forth below with reference to FIGS. 14–21, and the details of the hand grip 44 are described with reference to FIGS. 22 and 23.

With continued reference to FIGS. 3 and 4, the exercise system be also includes a second pair of exercise arm assemblies, each of which is mounted along the seat 14. Since the second pair of exercise arm assemblies are used principally for permitting the exercise of leg muscles, then this second pair of arm assemblies are referred to more specifically as the "leg assemblies"; however, as will be understood from the further description of the leg assemblies and the interconnected hip joint assemblies, all depicted in FIGS. 24–32, these are closely related in design to the shoulder and exercise arm assemblies described above and depicted in FIGS. 9–21.

Each leg assembly includes a first leg segment 52 and a second leg segment 56 pivotably coupled to the first leg segment, with a positive linkage belt 54 coupling the two leg segments together via a sprocket arrangement. Each leg assembly is coupled to a corresponding one of the horizontal support rails 21 alongside the seat 14, as is more fully described below with reference to FIGS. 24–27. The particular details of each leg assembly are thereafter described with reference to FIGS. 28–33. Each leg assembly also includes elastomeric tensioning bands 42, and an extension pad 58 for engaging the foot of the person undertaking the exercise upon the exercise system 10.

Each of the major components of the exercise system will now be described with reference to the corresponding drawing figures.

Shoulder Rod Assembly

Turning now to FIGS. 5–8, the index plate assembly 28 has a pair of spaced indexing plates 282 which are coupled to the rear surface of the back rest 24. The indexing plates 282 include spaced apart indexing holes 286, which are dimensioned to receive an indexing pin 285. A pair of collars 283 are supported by a stanchion 281 extending across the rear surface of the back rest 24, with one of the vertical supports 20 extending through and fastened with a corresponding collar 283. Additionally, a pair of collars 284 are fixed on the ends of the stanchion 281, with the shoulder rod 26 extending through the collars 284, the indexing plates 282 and an indexing member 265, described below.

The shoulder rod 26 includes fastening collars 261 on either side of the support collar 284, a spacer collar 262, and an end cylinder 263. Each end cylinder 263 has a lateral joint 264 through which extends a pivot rod 266, for joinder of the shoulder bracket 30, as described in greater detail below with reference to FIGS. 9 and 10.

The shoulder rod 26 also has a fixed central indexing member 265 which is fixed to the shoulder rod 26 between the two indexing plates 282.

It will be appreciated by those skilled in the art that the shoulder rod 26 may be rotated by removal of the indexing pin 285, to thus permit the indexing member 265 to be rotated together with the shoulder rod 26 to a new position, at which time the indexing pin 285 may be inserted through a desired indexing hole 286 to thereby change the angular position of both shoulder brackets 30 (and thus both of the exercise arm assemblies), as is desired by the person engaging in the exercise program.

Shoulder Bracket Assemblies

The shoulder bracket assembly 30 is described with reference to FIGS. 9–13.

The shoulder bracket assembly 30 includes spaced, parallel bracket plates 301, 302 which are supported in a spaced apart condition by support rods 305, 306. (As shown in FIG. 3, the two rods 305, 306 may be used to store extra elastic tensioning bands 42.) Additionally, a rotation rod 303 extends between the two plates 301, and supports an upper arm sprocket 323 and adjacent bearing plates 327.

Figure 12:
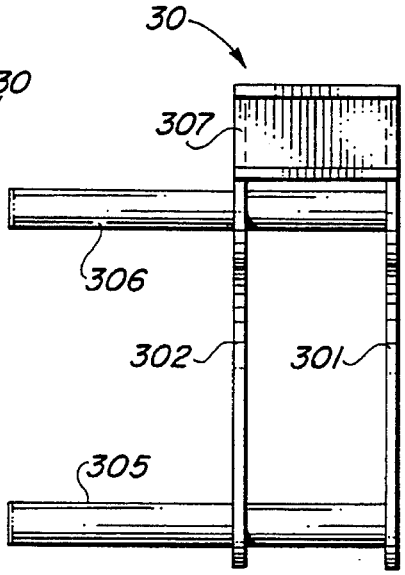
FIGS. 11, 12 and 13 are side, top and end views, respectively, of the shoulder bracket assembly of the system and apparatus of the present invention.
Figure 11:
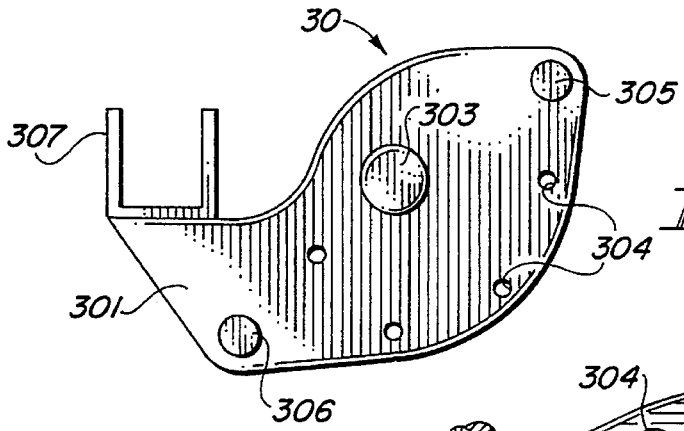
Figure 13:
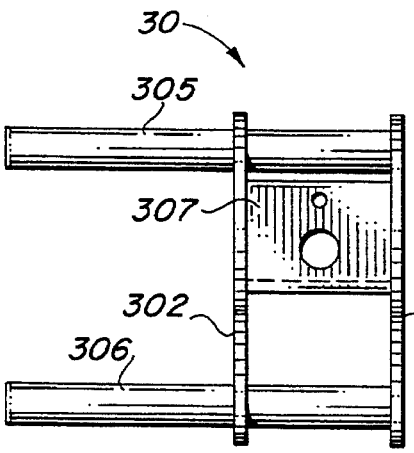

The shoulder bracket assembly 30 includes a U-shaped bracket 307 mounted so as to engage the extremity of a corresponding shoulder rod cylinder 263 by insertion of the pivot rod 266 through the bracket 307 (the specific construction details of the shoulder bracket assemblies 30 and the U-bracket are shown in FIGS. 11–13).

Figure 10:
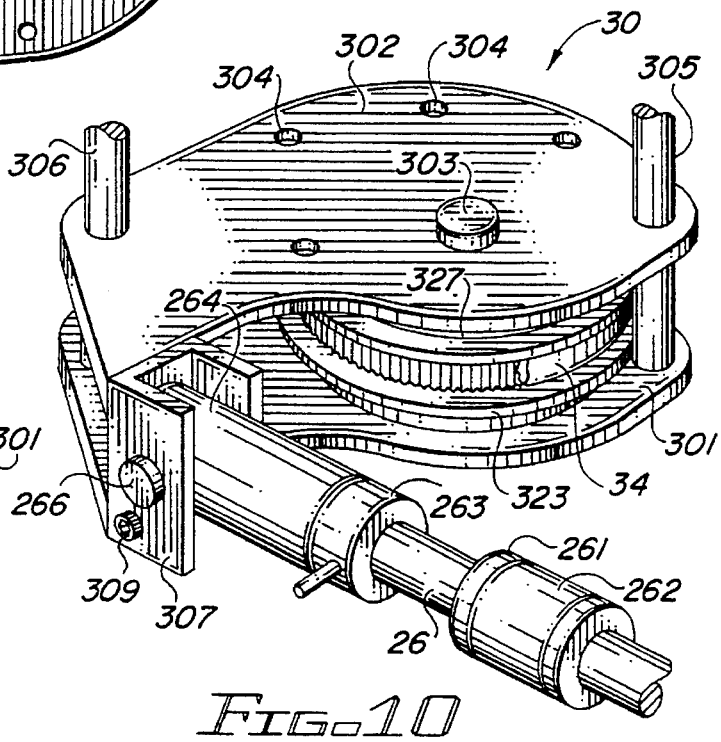
Figure 17:
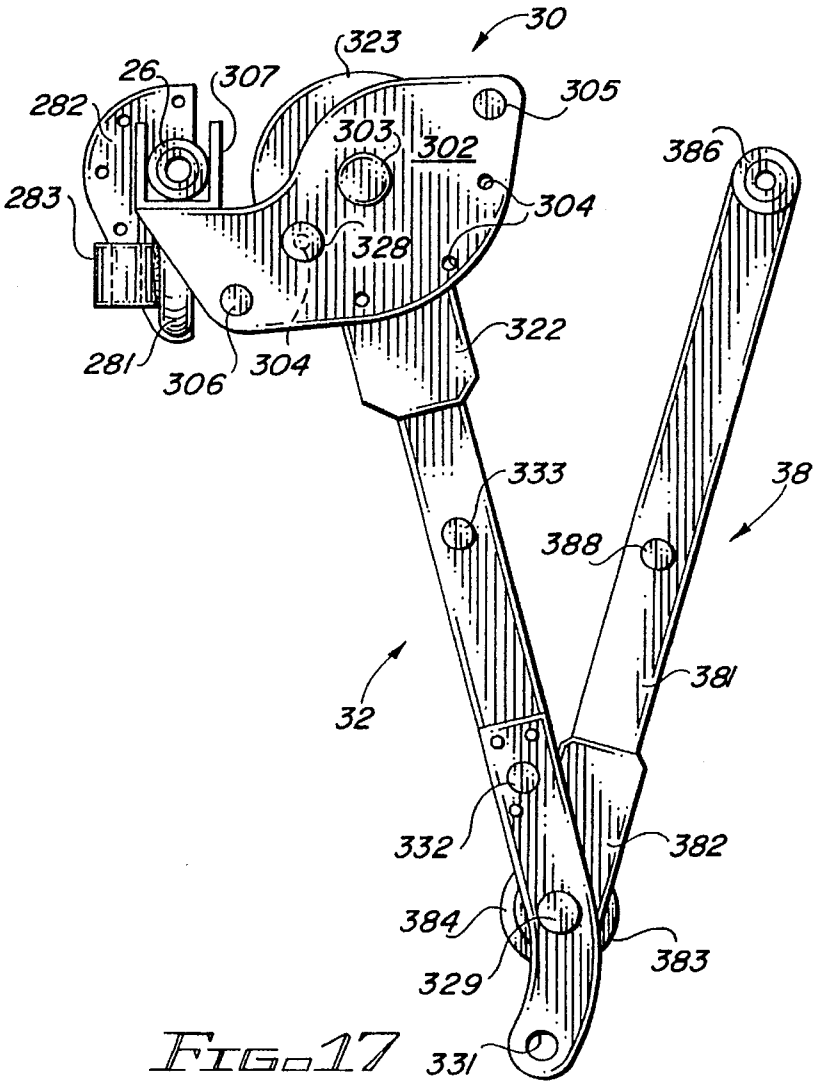
FIG. 17 is a side view of the shoulder bracket and arm assembly.

The shoulder bracket assembly 30 is capable of rotation about the pivot rod 266 between two positions, by removal of a locking pin 308 from the U-bracket 307. The position of the shoulder bracket assembly 30 after removal of the locking pin 308 and after rotation is shown in FIG. 10. As will be evident from the discussion of the left hand portion of FIG. 47 below, the rotation of the shoulder bracket assembly 30 permits the exercise arm assembly to be utilized for exercises which are in a plane lateral to the longitudinal axis of the body of the person exercising.

The plates 301, 302 include plural, spaced holes 304 across the front periphery which are utilized with an indexing pin 328 (FIG. 17) to change the angular relationship of the exercise arm assembly 32, 38 (and thus, the restricted straight line of exercise) with respect to the person exercising.

Exercise Arm Assemblies

One form of the exercise arm assembly will now be described with reference to FIGS. 14–21.

The exercise arm assembly includes a first, or upper, arm segment 32 and a second, or forearm segment 38 and an inner connecting positive linkage belt 34 between those two segments 32, 38.

Figure 14:
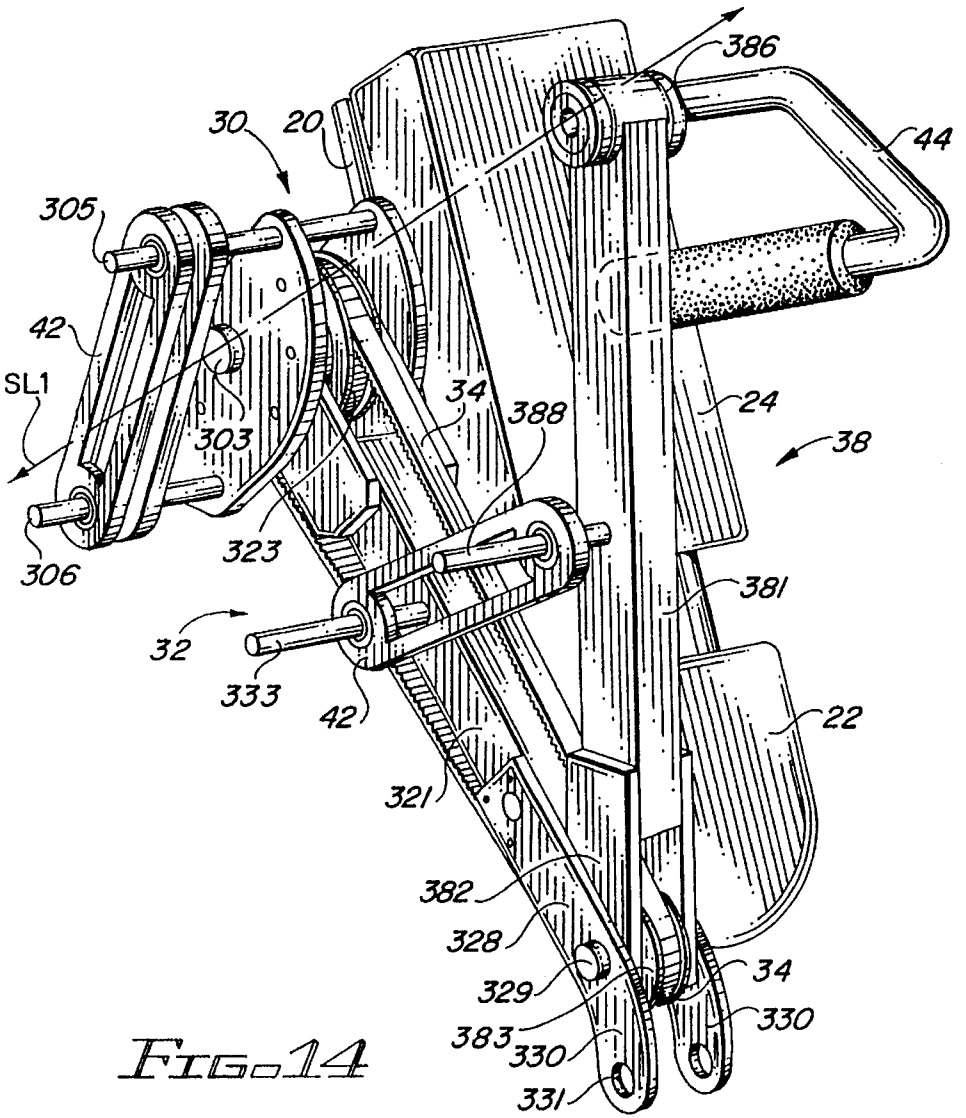
FIGS. 14, 15 and 16 are perspective views illustrating the arm assemblies of the system and apparatus of the present invention.
Figure 15:
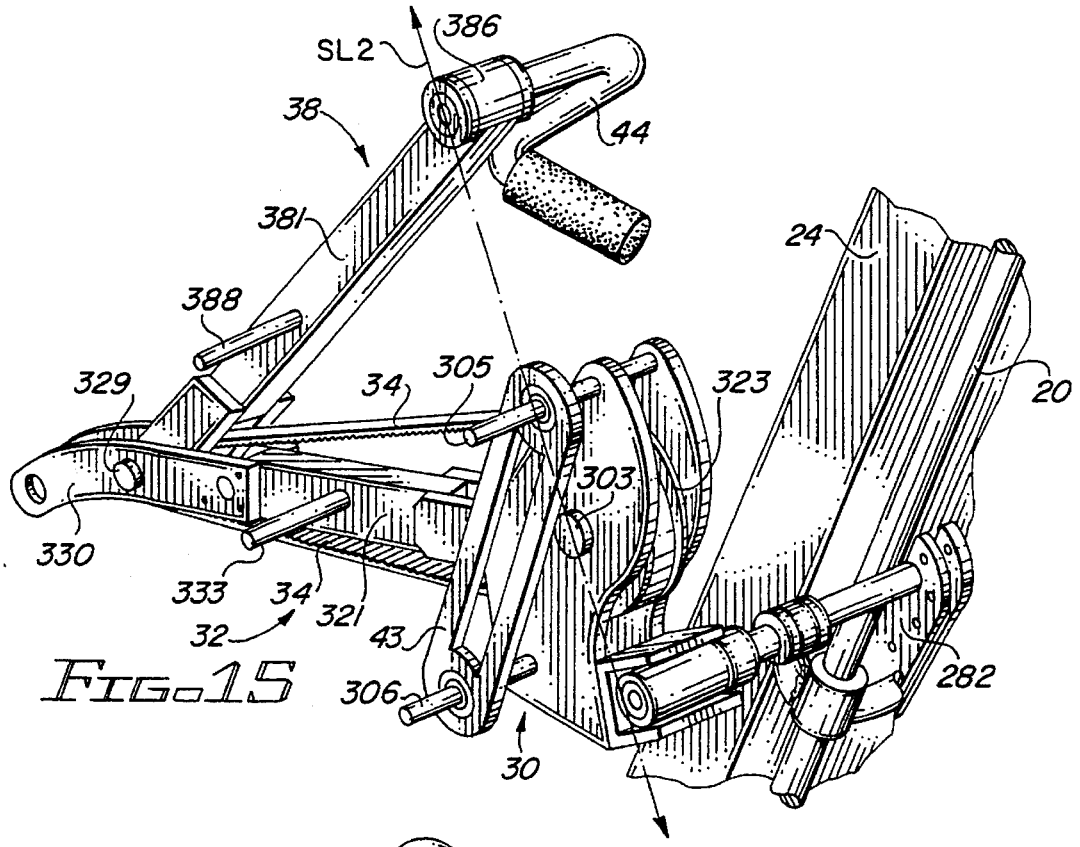
Figure 16:
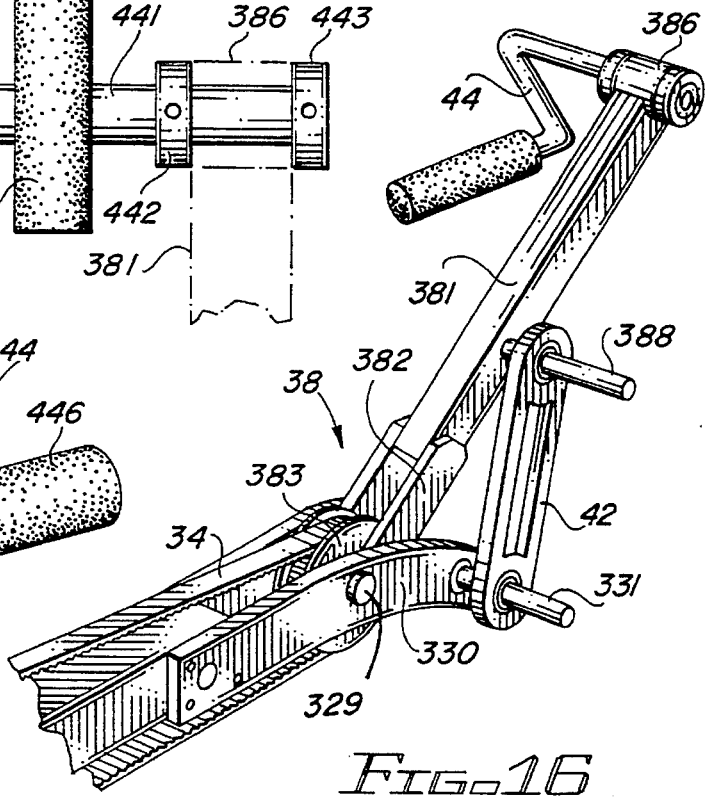
Figure 18:
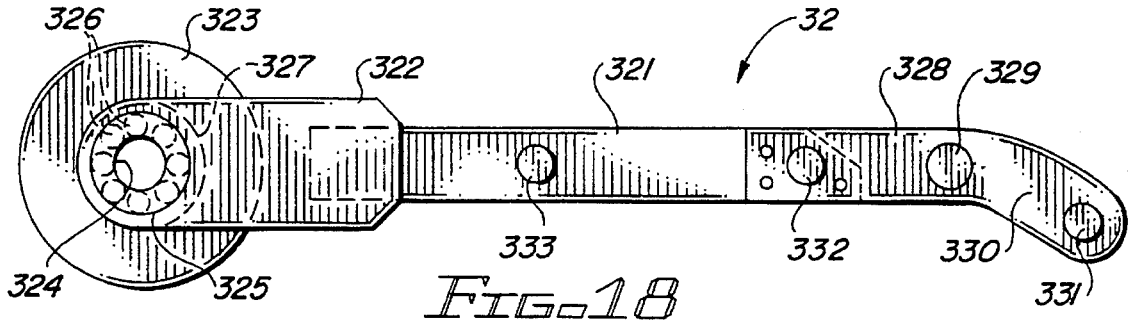
FIGS. 18 and 19 are side and top views of the first, upper arm segment of the exercise arm assemblies depicted in FIGS. 14–17.
Figure 19:
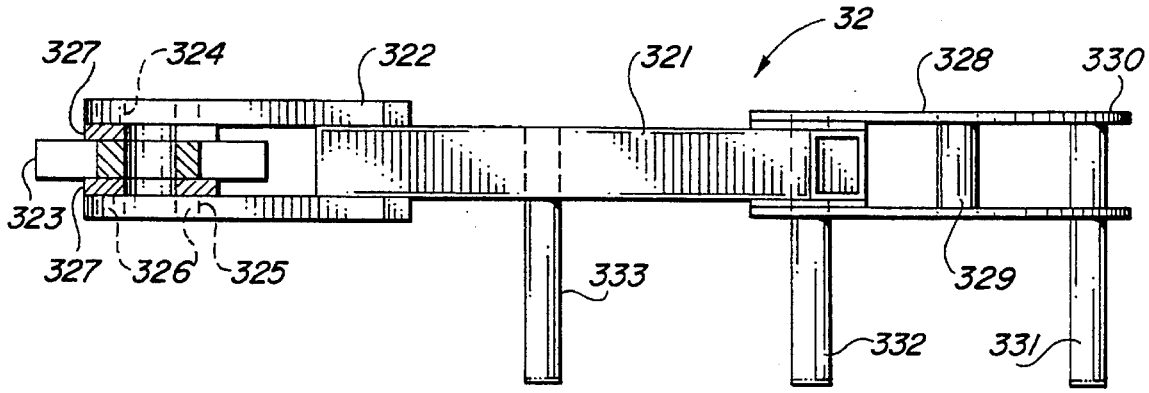
Figure 20:
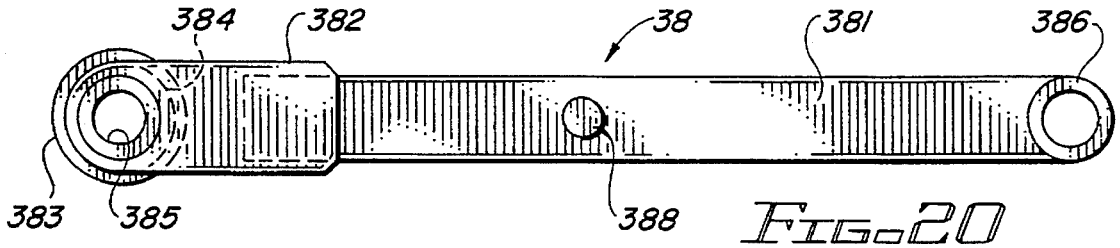
FIGS. 20 and 21 are side and top views respectively of the second, forearm segment of the exercise arm assembly shown in FIGS. 14–17.
Figure 21:
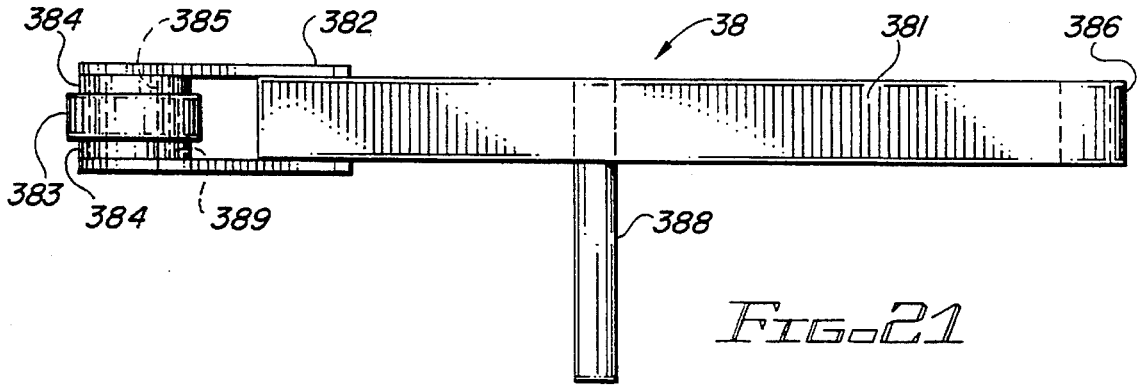

Noting FIGS. 14–19, the upper arm segment 32 includes an intermediate arm portion 321 having a proximal end fork 322 formed of spaced parallel plates which support a rotatable toothed sprocket 323 and adjacent bearing assemblies comprising bearing plates 327, bearing housing 325 and roller bearings 326. The fork 322, bearing plates 327 and toothed sprocket 323 all define a central opening 324 through which the rod 303 extends to support the upper arm segment 32 with the shoulder bracket assembly 30 (note to FIGS. 14 and 15). The upper segment 32 includes a distal fork 328 defined by parallel plates attached to the distal end of the intermediate arm portion 321; the distal fork 328 includes a rod 329 between the plates, and further defines an extension 330 beyond the rod 329. Resistance member support pins 331, 332 and 333 are respectively attached to the extremity of the extension 330, to the intersection of the intermediate arm portion 321 and the distal fork 328, and centrally along the intermediate arm portion 321, as is shown in FIGS. 18 and 19. These three resistance elements support pins 331, 332 and 333 are utilized together with similar pins 305 and 306 on the shoulder bracket assembly 30, and with another resistance element support pin 388 along the second, forearm segment 38 of the exercise assembly. One such arrangement is shown with the elastic resistance element 42 extending between pins 333 and 388, and is used to obtain negative resistance during movement of the exercise arm assembly. Another arrangement is shown in FIG. 16, with the exercise resistance band 42 between pins 331 and 388, order to obtain a positive resistance to movement of the exercise arm assembly.

FIGS. 14–17 and 20–21 also illustrate the second, forearm segment 38 of the exercise arm assembly. The forearm assembly 38 includes an intermediate arm portion 381 having a proximal end fork 382 defined by parallel plates supporting a toothed sprocket 383 and spacer plates 384. The fork 382, toothed sprocket 383 and plates 384 all include an opening 385 dimension to receive the pivot rod 329 (FIG. 17); further, the fork 382, plates 384 and sprocket 383, while rotating about the rod 329, are all fixed together by pins 389, shown by dotted lines in FIG. 21 (that is to say, while the toothed sprocket 383 rotates about rod 329, it rotates together with the entire forearm segment 38). In accordance with this invention, the upper arm sprocket 323 has a 2-to-1 toothed relationship with respect to sprocket 383, in order to achieve the desired straight line movement of the distal end of the forearm segment 38 through the center point of the pivot rod 303, as discussed in greater detail below.

Figure 23:
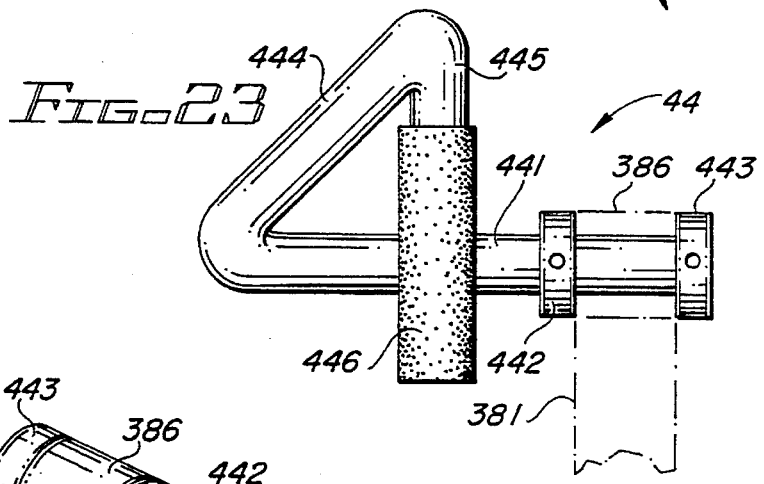
FIGS. 22 and 23 are perspective and front views respectively of an exercise hand grip useful with the exercise arm assemblies shown in FIGS. 14–21.
Figure 22:
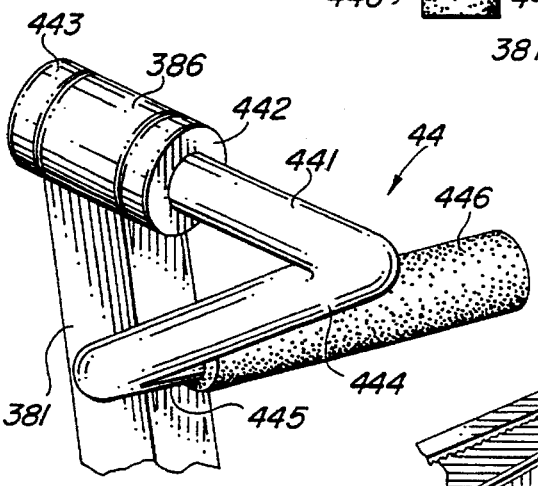

The forearm segment 38 includes a journal 386 at its distal extremity for receiving the hand grip shaft shown in FIGS. 22 and 23. The forearm segment 38 also includes a tension support pin 388 extending laterally from the intermediate arm portion 381 (note FIG. 21).

As shown in FIGS. 14, 15 and 16, the toothed belt 34 extends around both sprockets 323 and 383, so that as the journal 386 of the forearm segment 38 is pushed away from, or pulled toward, the shoulder bracket assembly 30, the movement of the entire forearm segment 38 causes the toothed belt 34 to be rotated about the forearm segment sprocket 383; this in turn causes rotation of the upper arm sprocket 323. Because of the specific tooth relationship of the sprockets 323 and 383, the distal end of the forearm segment 38 is displaced only along a straight line, the direction of the line depending upon the angular relationship of the shoulder bracket assembly 30. One such straight line is shown in FIG. 14, and designated as SLY; as can be seen, this first straight line SL1 is directed essentially lateral to the backrest of the exercise assembly 10. On the other hand, in FIG. 15, a second straight line SL2, is shown directly substantially upwardly at an acute angle with respect to the backrest 24, because the angular relationship of the upper arm assembly 32 has been changed by a movement of the pin 328 into an appropriate one of the adjustment holes 304 in the shoulder bracket assembly 30. The manner in which different constricted straight line movements may be used to achieve specific exercise benefits will be described below with respect to FIGS. 34–47.

Hand Grip Assembly

The hand grip assembly will now be described with reference to FIGS. 22 and 23. The hand grip assembly, referred to generally by reference numeral 44, includes a rod 441 extending through the distal end member forearm assembly 38, and is supported therein with collars 442 and 443. A first extension member 444 is joined to the rod 441 at its inside end, and extends angularly and downwardly toward the outside of the exercise system 10 (note FIGS. 3 and 34). A second extension member 445 then extends from the extremity of the first member 444 and toward the back support 24, and includes a hand grip 446 along the second member 445. As will be understood from a review of FIG. 23, the entire hand grip assembly 44 rotates freely around the distal end of member 386 of the forearm assembly 38, and with the hand grip 446 lying approximately in the same planes as that distal end member. This construction facilitates the straight line restriction exercise techniques which are achieved by the system 10 of the present invention.

Hip Joint Assembly

The hip joint assembly of the exercise 10 will now be described with references to FIGS. 24–27. The hip joint assembly, referred to generally by the reference numeral 50, has a construction and method of operation which is quite similar to the shoulder joint assembly 30 shown in FIGS. 9–13.

Figure 26:
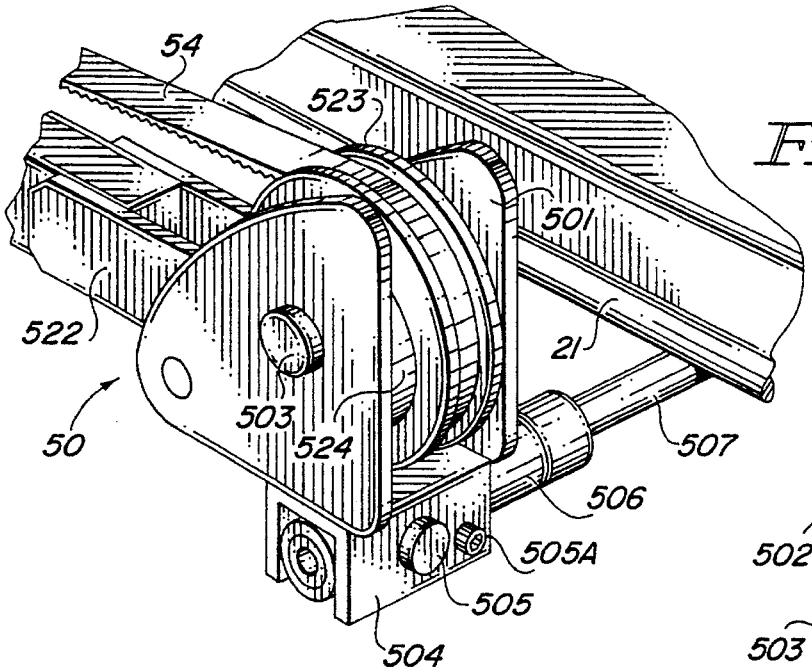
FIGS. 26 and 27 are perspective views illustrating different positions of the hip joint assembly with respect to the exercise system.
Figure 25:
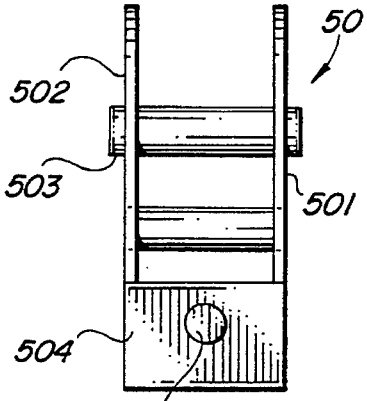
FIGS. 24 and 25 are respective side and front views illustrating a hip joint assembly for the leg assemblies of the present invention, which leg assemblies are depicted in detail in FIGS. 28–33.
Figure 24:
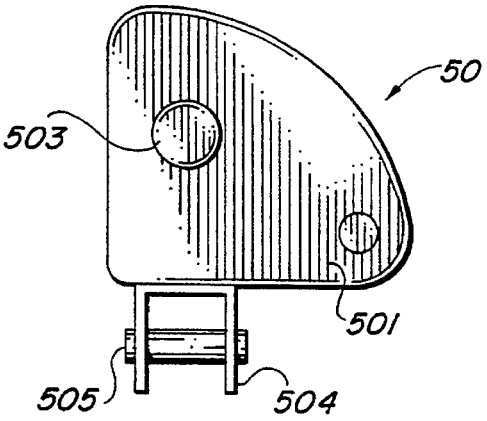
Figure 27:
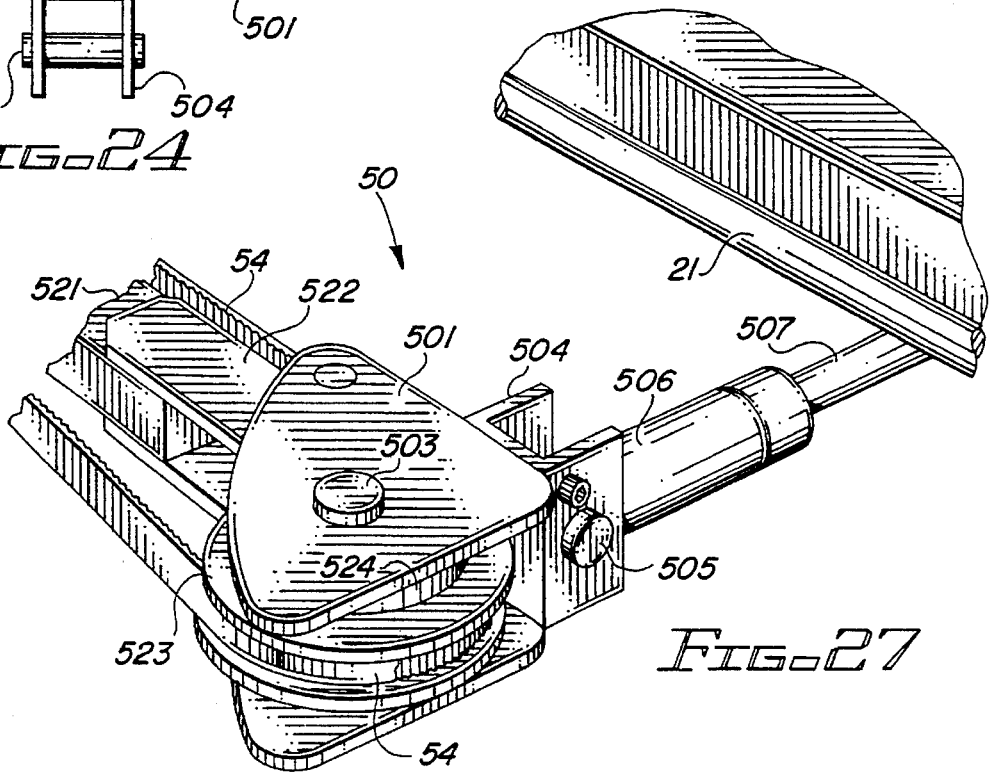

The hip joint assembly 50 includes a pair of parallel plates 501, 502 with a pivot rod 503 extending between those plats. A U-shaped bracket 504 having a pivot rod 505 extending across its respective arms is attached and extends laterally to the direction of the plates 501, 502. As is shown in FIGS. 26 and 27, the U-shaped bracket 504 is attached by a pivot rod 505 to the extremity of a collar 506 attached to the end of a hip rod 507. The hip rod 507 is in turn attached to the seat support 21. In use, the hip joint assembly may be rotated between an upright position as shown in FIG. 26, to a lateral position as shown in FIG. 27 through removal of a pin 505A (FIG. 26), to permit the hip joint assembly 50 to rotate between those two positions.

Hip Leg Assembly

The details of the exercise leg assembly will be described with reference to FIGS. 28–33. In these figures, major assembly reference numeral 52 refers to the upper, or thigh portion of the exercise leg assembly, and reference numeral 56 refers to the lower, or calf segment of the exercise leg assembly.

Figure 28:
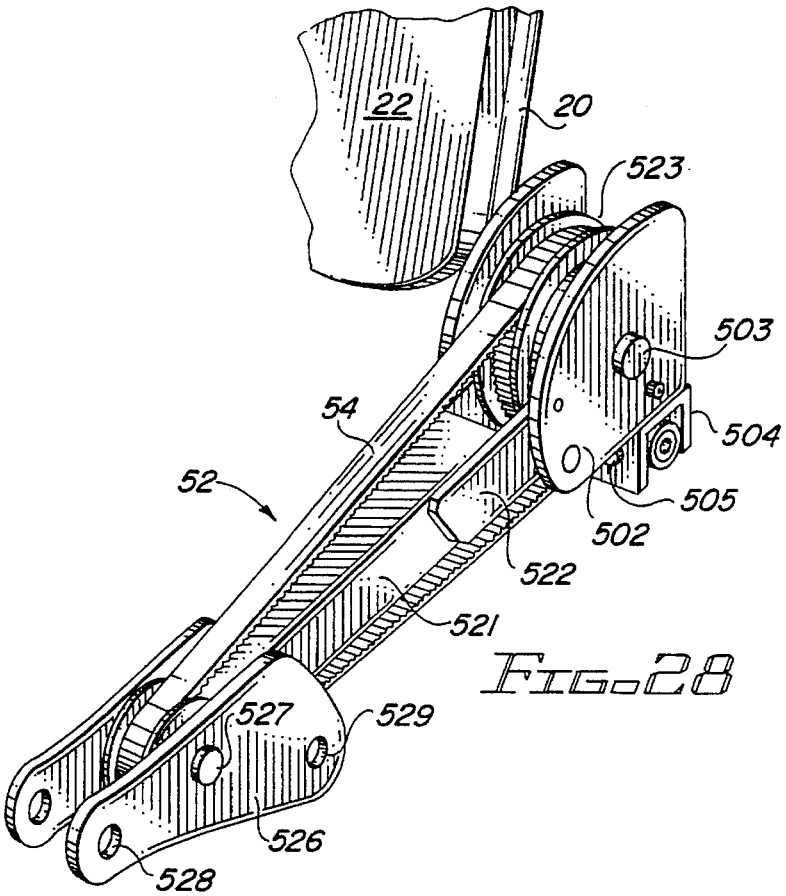
FIGS. 28 and 29 are perspective and side views, respectively, of an exercise leg assembly useful with the exercise system.
Figure 30:
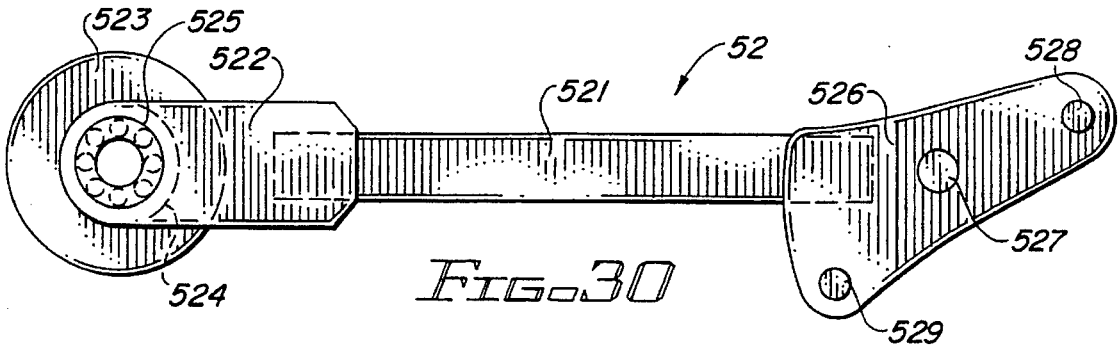
FIGS. 30 and 31 are respective side and top views of a first, upper segment of the leg assembly shown in FIGS. 28 and 29.
Figure 31:
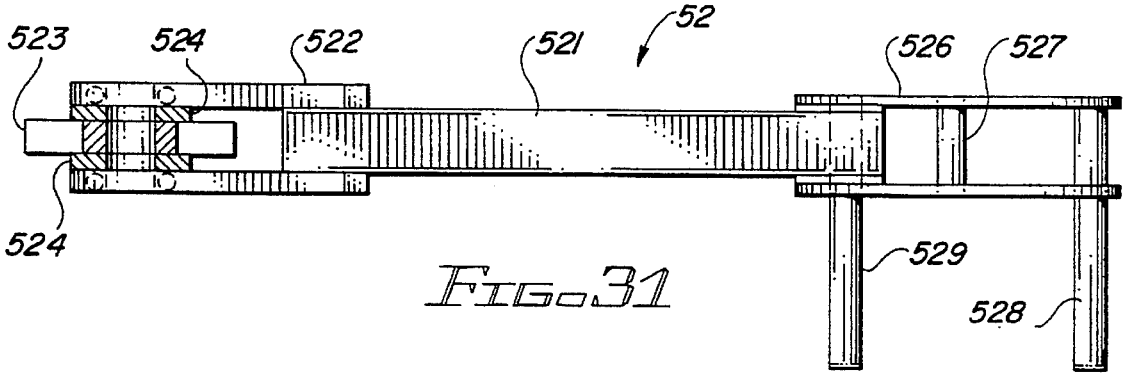

Referring first to FIGS. 28, 30 and 31, the thigh segment 52 of the exercise leg assembly includes an intermediate leg portion 521 with a fork 522 at its proximal end formed by parallel plates which extend between the plates 501, 502 of the hip joint assembly, and are rotatably supported by the pivot rod 503 (note also FIGS. 26 and 27). The thigh segment 52 includes a rotatable toothed sprocket 523 also supported axially on the pivot rod 503, and is separated from the parallel forks 522 by bearing plates 524 (note FIGS. 30 and 31) and is carried by a bearing 525.

The thigh segment 52 also includes a parallel fork 526 at its distal end defined by parallel plates with a pivot pin 527 extending between the two plates of the fork 526. A pair of exercise tension pins 528 and 529 extend across the fork 526, one located below the distal extremity of the intermediate portion 521 along the fork 526 (pin 529) and the other pin 528 located at the distal extremity of the fork 526.

Figure 32:
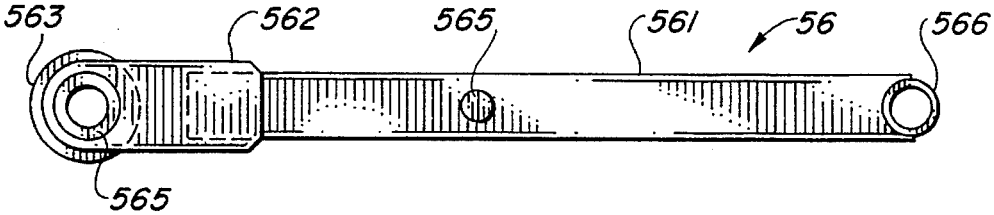
FIGS. 32 and 33 are respective side and top views of the second, lower segment of the exercise leg assemblies of FIGS. 28 and 29.
Figure 33:
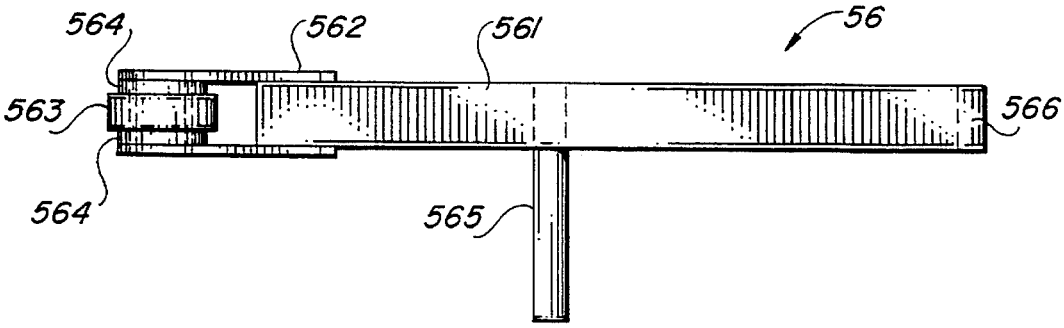

The calf segment 56 of each exercise leg assembly has a construction essentially identical to the forearm segment 38 of the exercise arm assemblies described above. As shown in FIGS. 32 and 33, the calf segment 56 includes an intermediate portion 561 having a parallel fork 562 at its proximal end with a toothed sprocket 563 with rotatable about pivot pin 527 (FIG. 28) and with fixed spacer pads 564 between the sprocket 563 and the sides of the fork 562. An exercise tension support pin 565 extends laterally from the intermediate portion 561 and the distal end of the intermediate portion 561 has a bearing block 566 for supporting a conventional foot rest extending laterally and inwardly from the calf segment 56, as shown in FIG. 3.

Figure 29:
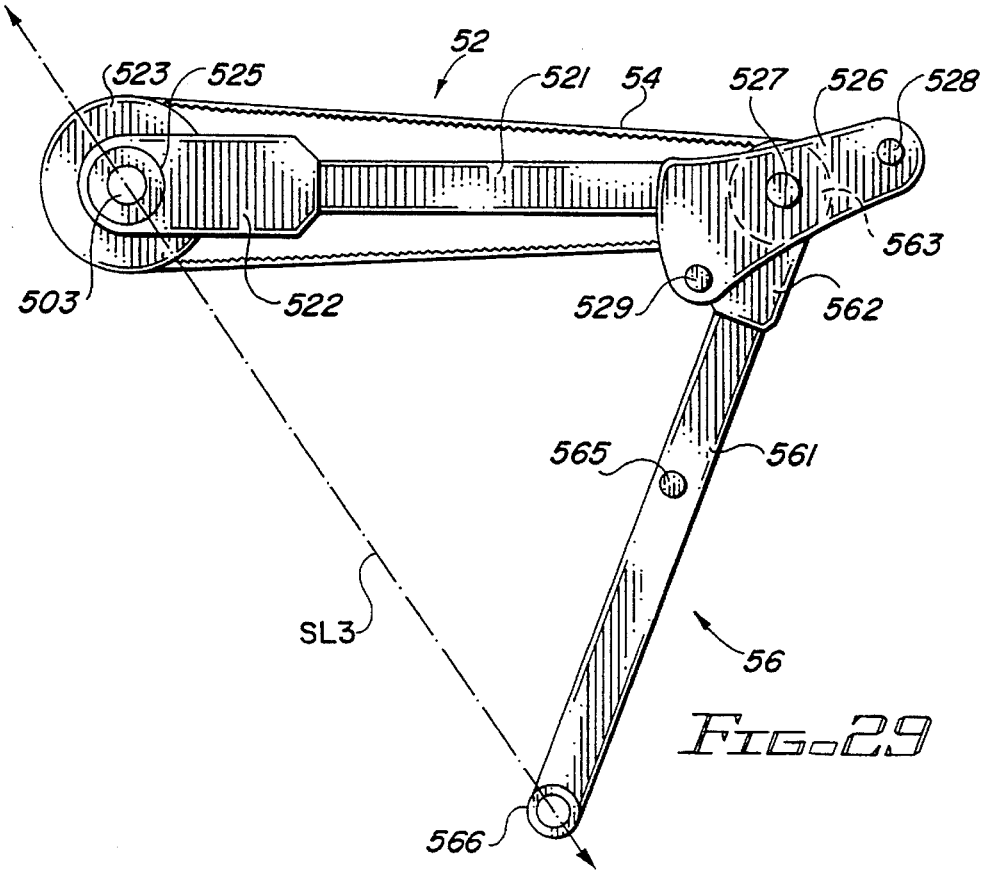

As shown in FIGS. 26–29, a toothed belt 54 extends around the sprockets 523, 563 and with the sprockets arranged in the 2-to-1 ratio described above with respect to the exercise arm assembly. In this manner, and as is shown in FIG. 29, the movement of the distal end 566 of the calf segment 56 toward or away from the center line defined by pivot rod 503 of the proximal end of the thigh assembly 52 is only along a straight line SL3, thus achieving the desired restricted movement of the exercise leg assembly in accordance with this invention, and is described in greater detail in the next section.

Manner of Operation

Figure 34:
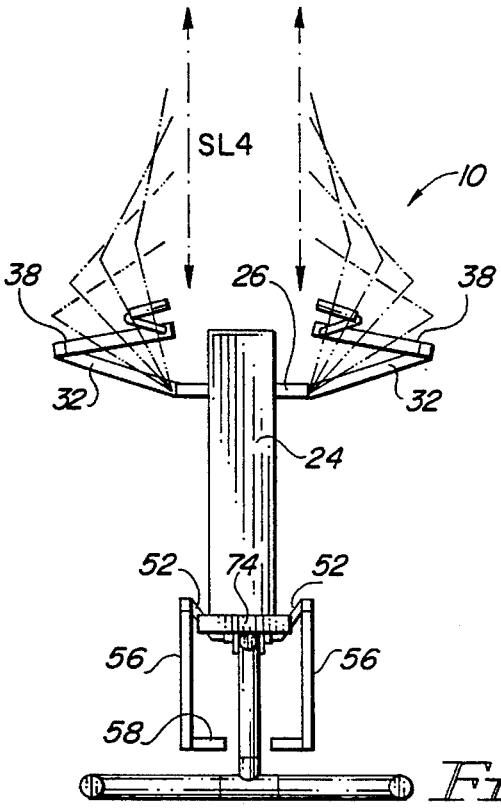
FIGS. 34 and 35 are schematic illustrations showing the manner of operation of the exercise system.
Figure 35:
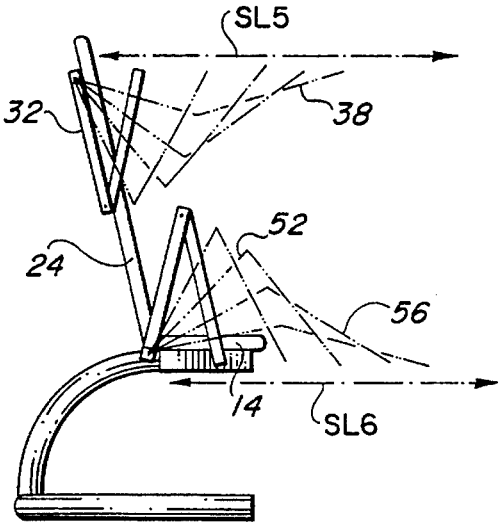
Figure 36:
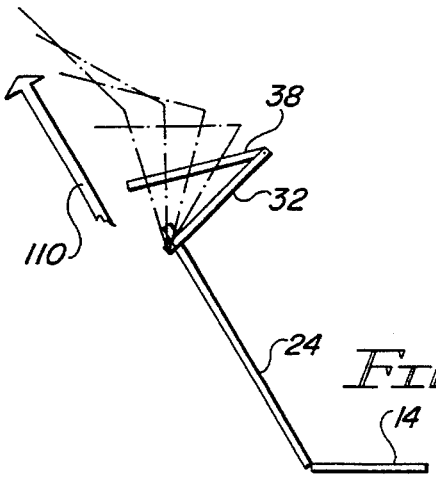
FIGS. 36–45 illustrate certain of the exercises which can be performed on the system and apparatus shown in FIGS. 1–35.
Figure 37:
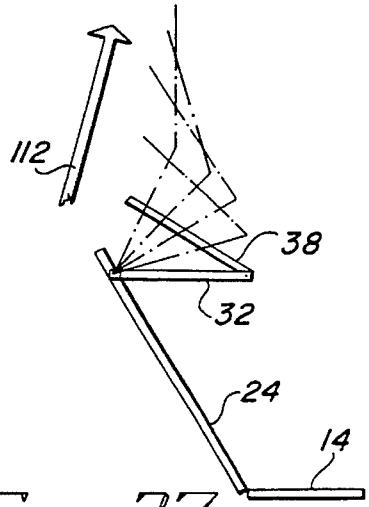
Figure 38:
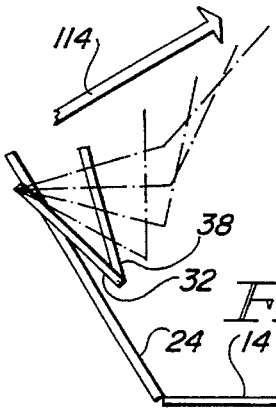
Figure 39:
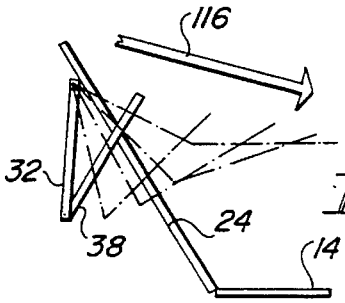

FIGS. 34 and 35 schematically illustrate how the exercise system 10 may be utilized to restrict the direction of exercise along a straight line SL4, and thereby carefully control the plane of exercise for a particular muscle group. In FIG. 34, straight line SL4 which provides a restrictive line of resistance either away from or toward the seat 14 in a generally vertical direction. If the resistance to movement along the restricted straight line SL4 is in a direction toward the seat 14, then a "pushing" exercise is achieved; on the other hand, if the elastic tensioning bands 42 are disposed on the system 10 in a manner so as to achieve resistance of movement along the restricted straight line SL4 in a direction away from the seat 14, then a "pulling" exercise is achieved.

Similarly, as is shown in FIG. 35, adjustment of the tensioning bands for movement along straight line SL5 will achieve a "pushing" exercise if resistance to movement along the restricted straight line SL5 is toward the back rest 24, whereas a "pulling" exercise is achieved if resistance to movement along restricted straight line SL5 is away from the back rest 24.

Figure 40:
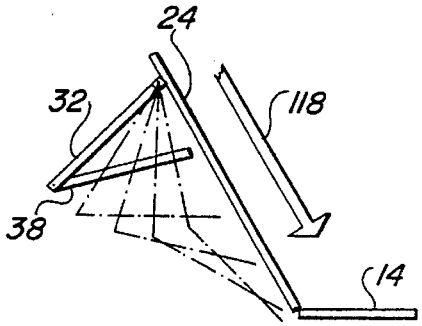
Figure 41:
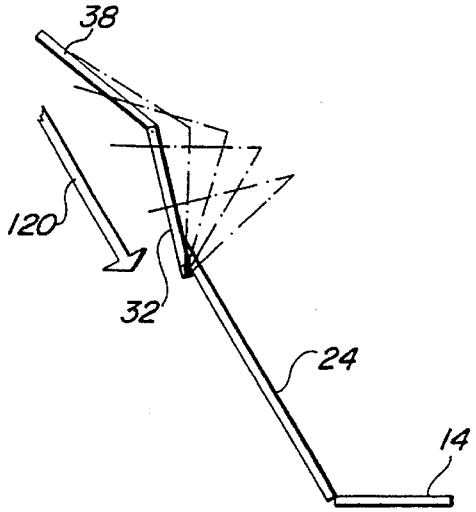
Figure 42:
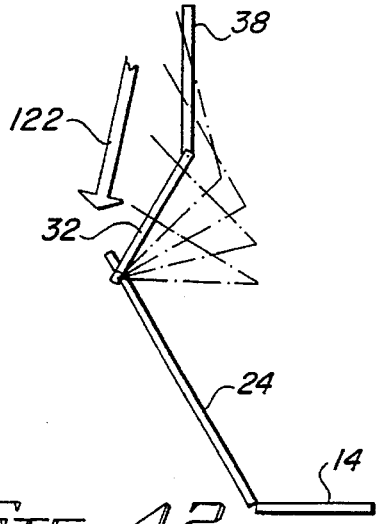
Figure 43:
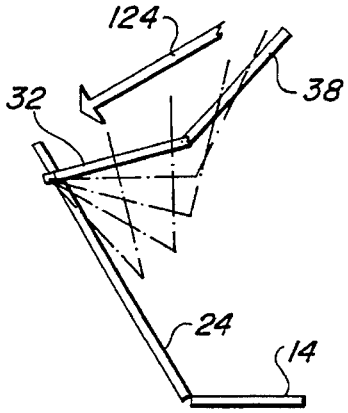
Figure 44:
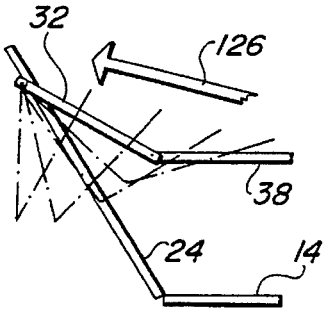

FIGS. 36–40 illustrate five different restricted straight lines 110, 112, 114, 116 and 118, all of which may be achieved as restricted straight lines of exercise by rotation of the shoulder assembly 30 through movement of the indexing plates 282, caused by changing the position of the indexing pin 285 to various indexing holes 286 (FIGS. 5–8). As is shown in FIGS. 36–40, the direction of exercise is in a direction away from the seat 14 and back rest 24 with the five exercises in FIGS. 36–40 being generally defined as follows: triceps military press (FIG. 36); triceps incline press (FIG. 37); triceps bench press (FIG. 38); triceps decline press (FIG. 39); and triceps dip (FIG. 40).

Figure 45:
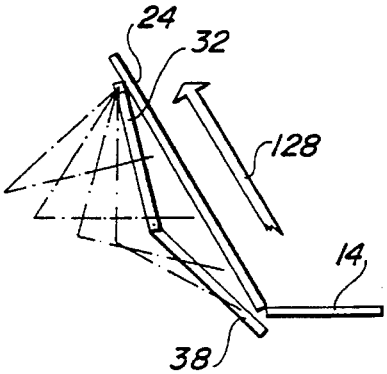

As is shown in FIGS. 41–45, an entirely different series of exercises are achieved by simply changing the resistance of bands 42 so that the exercise is in a direction generally toward either the seat 14 or back rest 24, as is illustrated by straight lines 120, 122, 124, 126 and 128. These five exercises are generally described as: chin up (FIG. 41); incline row (FIG. 42); flat row (FIG. 43); decline row (FIG. 44); and upright row (FIG. 45).

Figure 46:
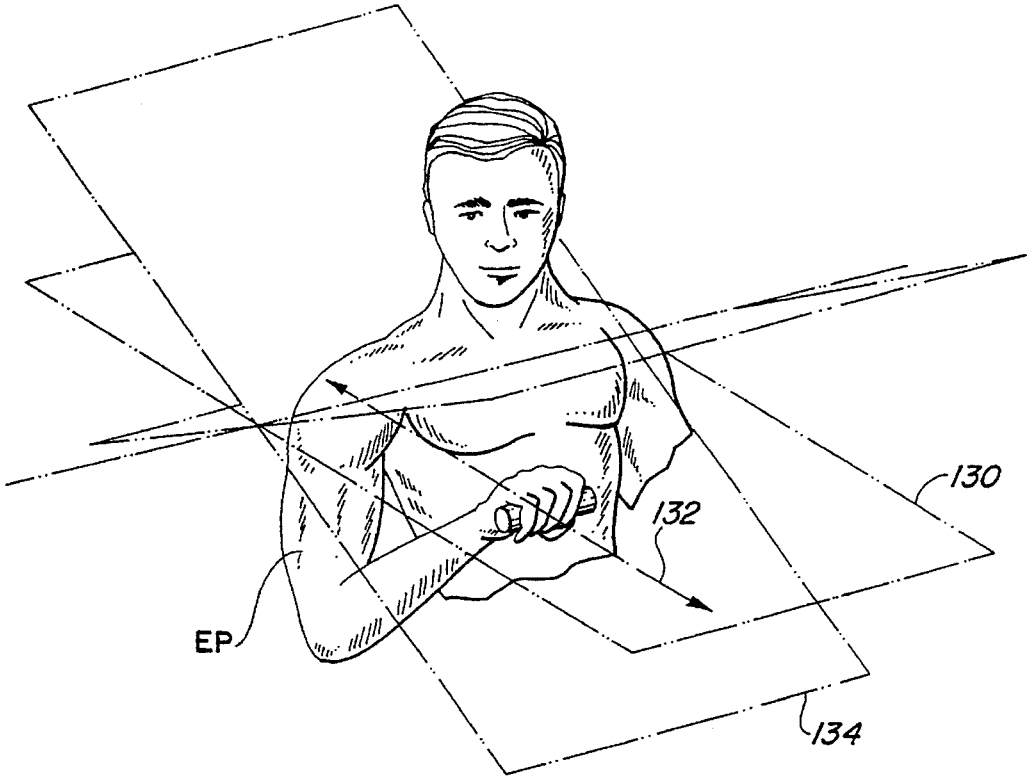
FIGS. 46 and 47 are perspective and top views illustrating features of the exercise system.

FIG. 46 is a perspective illustration showing an exercising person EP using one exercise arm assembly having a hand grip 446 which is used to direct the exercise along a restricted plane 230 containing restricted straight line of exercise 232. As was described previously with respect to FIGS. 36–45, the exercise system 10 may be adjusted to thereafter permit the restricted straight line 132 to lie in a second (or third, etc.) plane 234.

Figure 47:
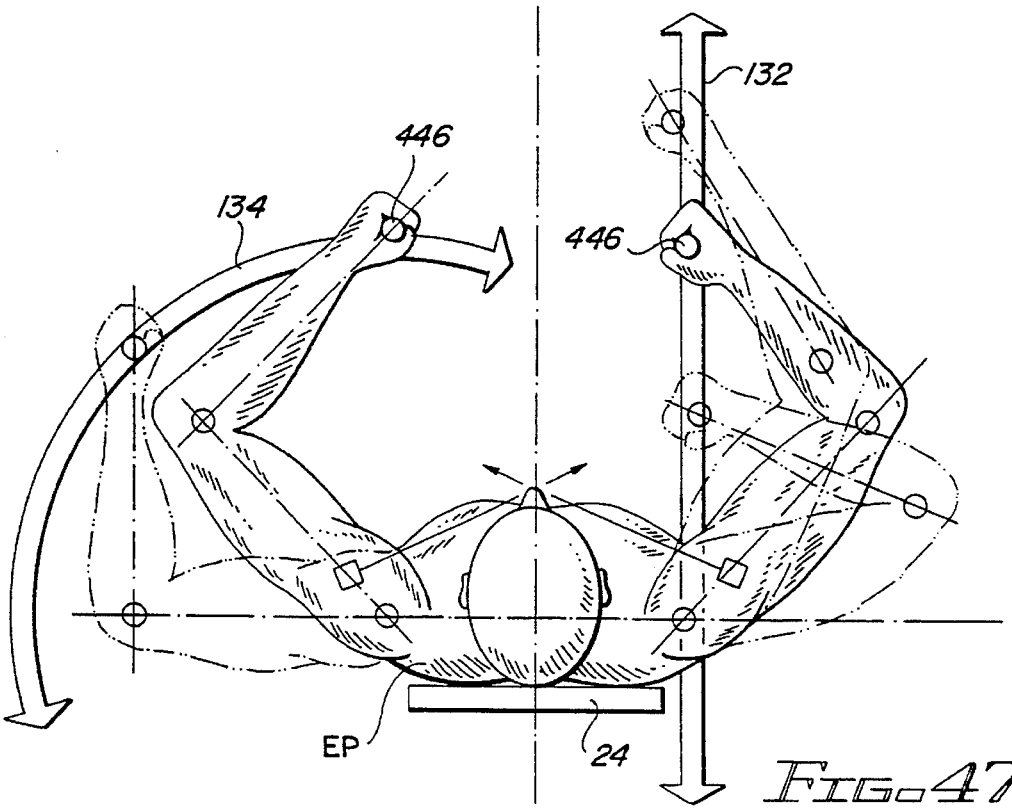

Noting FIG. 47, the exercise system 10 has the ability to achieve the restricted straight line movement as shown with respect to straight line 132, or alternatively be rotated at the shoulder bracket via U-shaped bracket 307 and indexing pin 308 (FIGS. 9 and 10) to permit the shoulder bracket assembly 30 to be rotated at an outward angle, and achieve a conventional curved displacement of the hand grip 446, as is shown by curved line 134 on the left side of FIG. 47; however, in accordance with the present invention, curved line 134 lies in a restricted plane.

Optimum Exercise Regimen Using Exercise System 10

Through empirical analysis, it has been determined that a proper alignment of the restricted straight line movement for different exercises achieves an optimal exercise regimen. This regimen is cataloged below in relation to the closest traditional exercise:

| Closest "Traditional" Exercise | Proper Alignment |
|---|---|
| I. DOUBLE JOINT MOVEMENTS - UPPER BODY | |
| Elbows In - Pushing | |
| 1 Triceps Military Press | 170° from body line |
| 2 Triceps Incline Press | 125° from body line |
| 3 Triceps Bench Press | 80° from body line |
| 4 Triceps Decline Press | 45° from body line |
| 5 Triceps Dips | 5° from body line |
| Elbows out - Pushing | |
| 6 Military Press | 170° from body line |
| 7 Incline Press | 125° from body line |
| 8 Bench Press | 80° from body line |
| 9 Decline Press | 45° from body line |
| 10 Wide Grip Dips | 5° from body line |
| Elbows In - Pulling | |
| 11 Biceps Pulldown | 170° from body line |
| 12 Biceps Incline Pulldown | 125° from body line |
| 13 Biceps Row | 80° from body line |
| 14 Biceps Decline Row | 45° from body line |
| 15 Biceps Upright Rows | 5° from body line |
| Elbows Out - Pulling | |
| 16 Wide Lat Pulldown | 170° from body line |
| 17 Incline Lat Pulldown | 125° from body line |
| 18 Wide Grip Row | 80° from body line |
| 19 Wide Decline Row | 45° from body line |

-continued

| Closest "Traditional" Exercise | Proper Alignment |
|---|---|
| 20 Wide Upright Rows | 5° from body line |
| DOUBLE JOINT MOVEMENTS - LOWER BODY | |
| Leg Press/Squats | |
| 21 Seated Leg Press | 67.5° from body line |
| 22 Decline Leg Press | 37.5° from body line |
| 23 Incline Squat | 15° from body line |
| Abdominal/Knee Lifts | |
| 24 Seated Knee Lift | 67.5° from body line |
| 25 Decline Knee Lift | 37.5° from body line |
| 26 Reverse Squat | 15° from body line |
| II. SINGLE JOINT MOVEMENTS - UPPER BODY | |
| Adductor Flyes - Arms Out/Fly in | |
| 27 Military Flyes | 170° from body line |
| 28 Incline Flyes | 125° from body line |
| 29 Flat Flyes | 80° from body line |
| 30 Decline Flyes | 45° from body line |
| 31 Upright Lat Flyes | 5° from body line |
| Abducter Flyes - Arms in/Fly out | |
| 32 Lat Flye Pulldown | 170° from body line |
| 33 Incline Rear Delt Flyes | 125° from body line |
| 34 Rear Delt Flyes | 80° from body line |
| 35 Decline Rear Delt Flyes | 45° from body line |
| 36 Lateral Delt Flyes | 5° from body line |
| Upper Arm | |
| 37 Isolated Biceps Curls | |
| 38 Isolated Triceps Extensions | |
| III. SINGLE JOINT MOVEMENTS - LOWER BODY | |
| Upper Leg | |
| 39 Isolated Leg Extensions | 67.5° from body line |
| 40 Isolated Leg Curls | 67.5° from body line |
| 41 Hip Flexion | |
| 42 Hip Extension | |
| 43 Seated Hip Adduction | 67.5° from body line |
| 44 Decline Hip Adduction | 37.5° from body line |
| 45 Lateral Hip Adduction | 15° from body line |
| 46 Seated Hip Abduction | 67.5° from body line |
| 47 Decline Hip Abduction | 37.5° from body line |
| 48 Lateral Hip Abduction | 15° from body line |
| Lower Leg | |
| 49 Seated Calf Raises | 67.5° from body line |
| 50 Decline Calf Raises | 37.5° from body line |
| 51 Calf Presses | 15° from body line |

This concludes the description of the preferred embodiments. A reading by those skilled in the art will bring to mind various changes without departing from the spirit and scope of the invention. It is intended, however, that the invention only be limited by the following appended claims.

What is claimed is:

1. Exercise apparatus comprising:

an exercise frame;

an exercise arm assembly having a proximal end coupled to the frame and a distal end;

means for limiting movement of the distal end of the arm assembly along a straight line which passes through the proximal and distal ends;

means for applying an exercise resistance to movement of the exercise arm assembly along the straight line and wherein the exercise arm assembly comprises first and second arm segments, with one end of the first arm segment comprising the proximal end and one end of the second arm segment comprising the distal end, and wherein the first and second arm segments are coupled together at a pivot intermediate between the proximal and distal ends.

2. The apparatus recited in claim 1 wherein the exercise resistance means applies a resistance to movement of the distal end away from the proximal end.

3. The apparatus recited in claim 1 wherein the exercise resistance means applies a resistance to movement of the distal end toward the proximal end.

4. The apparatus recited in claim 1 wherein the exercise resistance means is adjustable for applying resistance to movement of the distal end toward or away from the proximal end.

5. The apparatus recited in claim 1 further comprising means for changing the direction of the straight line from the proximal end.

6. The apparatus recited in claim 1 wherein the straight line limiting means comprises means for positively linking the first and second segments together to force simultaneous movement of the pivot as the distal end is moved along the straight line.

7. The apparatus recited in claim 6 wherein the positive linking means comprises:

a first sprocket rotatably supported by the first arm segment;

a second sprocket fixed to the second arm segment at the pivot; and a positive linkage belt engaging the first and second sprockets for rotation together.

8. The apparatus recited in claim 7 wherein the first sprocket has a diameter which is twice the diameter of the second sprocket.

9. The apparatus recited in claim 6 wherein the means for applying an exercise resistance along the straight line comprises means for applying an elastic tension between the first and second arm segments.

10. The apparatus recited in claim 9 wherein the elastic tension means is coupled at one end to the first arm segment at a point intermediate between the proximal end and the pivot, and a second end to the second arm segment at a point intermediate between the distal end and the pivot; and wherein the elastic tension is a resistance to a movement of the distal end away from the proximal end.

11. The apparatus recited in claim 9 wherein the first arm segment includes an extension beyond the pivot, and wherein the elastic tension means is coupled at one end to the extension and at a second end to the second arm segment at a point intermediate between the distal end and the pivot; and wherein the elastic tension is a resistance to a movement of the distal end toward the proximal end.

12. The apparatus recited in claim 1 wherein the first and second arm segments lie in an arm plane, the apparatus further comprising means for changing the angular relationship of the arm plane with respect to the frame.

13. The apparatus recited in claim 12 wherein the angular relationship changing means comprises a shoulder bracket rotatably attached between the frame and the proximal end of the arm assembly.

14. The apparatus recited in claim 13 further comprising a shoulder rod extending between the frame and the shoulder bracket.

15. The apparatus recited in claim 14 further comprising means for rotating the shoulder rod to thereby change direction of the straight line.

16. Exercising apparatus comprising:

an exercise frame including an upstanding back rest;

a pair of exercise arm assemblies, each arm assembly supported along one side of the back rest and having a proximal end adjacent the back rest and a distal end;

means for limiting movement of the distal ends of both exercise arm assemblies along an exercise plane in which both proximal ends and both distal ends lie;

means for applying an exercise resistance to the movement of each distal end across the exercise plane and wherein each exercise arm assembly includes an intermediate pivot between the corresponding proximal and distal ends, and wherein the movement limiting means comprises means for forcing movement of each pivot as the corresponding distal end moves across the exercise plane.

17. The apparatus recited in claim 16 wherein the proximal end, pivot and distal end of each arm assembly lies in a corresponding arm plane, the apparatus further comprising means for changing the angular relationship of the arm plane with respect to the frame.

18. The apparatus recited in claim 16 further comprising a shoulder bracket rotatably attached between the frame and the proximal end of each arm assembly.

19. The apparatus recited in claim 16 further comprising means for changing the angular relationship between the exercise plane and the back rest.

20. The apparatus recited in claim 19 wherein the exercise plane angular relationship changing means comprises:

a shoulder assembly fixed with the back rest and both of the arm assemblies; and means for rotating the shoulder assembly to effectuate changes in the angular relationship between the exercise plane and the back rest.

21. The apparatus recited in claim 20 wherein the shoulder assembly rotating means comprises a shoulder rod rotatably coupled with the shoulder assembly.

22. The apparatus recited in claim 16 wherein the exercise frame includes a seat extending generally lateral to and intersecting the back rest.

23. The apparatus recited in claim 22 further comprising a pair of exercise leg assemblies, each leg assembly supported along one side of the seat and having a proximal end adjacent to the seat-back rest intersection, and each leg assembly further including a distal end.

24. The apparatus recited in claim 23 wherein each exercise leg assembly comprises means with each leg assembly for limiting movement of the corresponding distal end along a straight line of exercise which passes through the distal end of the corresponding leg assembly and its proximal end.

25. The apparatus recited in claim 24 further comprising means for applying an exercise resistance to movement of each exercise leg assembly along the corresponding straight line.

26. The apparatus recited in claim 25 wherein the means for applying an exercise resistance along the corresponding straight line comprises means for applying an elastic tension between the proximal and distal ends of each leg assembly.

27. The apparatus recited in claim 25 wherein each exercise assembly comprises first and second segments, with one end of each first segment comprising the corresponding proximal end and one end of the second segment comprising the corresponding distal end, and wherein the first and second segments of each exercise assembly are coupled together at a pivot intermediate between proximal and distal ends.

28. The apparatus recited in claim 27 wherein each limiting means comprises means for positively linking the first and second segments of each corresponding arm and leg assembly together to force simultaneous movement of the corresponding pivot as the respective arm assembly distal end is moved through the exercise plane, or the respective leg assembly distal end is moved along the straight line.

29. The apparatus recited in claim 18 wherein the positive linking means comprises:

a first sprocket rotatably supported by the first arm or leg segment;

a second sprocket fixed to the second arm or leg segment at the corresponding pivot; and a positive linkage belt engaging each first and second sprocket for rotation together.

30. The apparatus recited in claim 29 wherein each first sprocket has a substantially greater diameter than the corresponding second sprocket.

31. The apparatus recited in claim 30 wherein the means for applying an exercise resistance comprises means for applying an elastic tension between the corresponding first and second segments of each exercise assembly.

32. The apparatus recited in claim 31 wherein the elastic tension means is coupled at one end to the first segment at a point intermediate between the proximal end and the pivot, and a second end to the second segment at a point intermediate between the distal end and the pivot; and wherein the elastic tension is a resistance to a movement of the distal end.

33. A multiple purpose system for exercising different muscles and for limiting a single exercise to a single straight line for a selected muscle, the system comprising:

an exercise frame including an upstanding back rest and a seat extending generally lateral from the back rest;

a pair of exercise arm assemblies, each arm assembly supported along one side of the back rest and having a proximal end adjacent the back rest and a distal end;

a pair of exercise leg assemblies, each leg assembly supported along one side of the seat and having a proximal end adjacent the seat-back rest intersection, each leg assembly also including a distal end;

means for limiting movement of the distal end of each exercise assembly along a straight line which passes through the corresponding proximal and distal ends; and means for applying an exercise resistance to movement of the exercise arm assembly along the corresponding straight line.

34. The apparatus recited in claim 33 further comprising:

each exercise arm and leg assembly including first and second segments with one end of the first segment comprising the corresponding proximal end and one end of the second segment comprising the distal end; and wherein the straight line limiting means comprises means for positively linking the first and second segments together to force simultaneous movement of the first and second segments as the distal end is moved along the straight line.

35. The apparatus recited in claim 34 wherein each first and second segment are coupled together at a pivot intermediate between the respective proximal and distal ends, the positive linkage means comprising:

a first sprocket rotatably supported by each first segment;

a second sprocket having a diameter of one-half the diameter of the first sprocket and fixed to each second segment at the pivot; and a positive linkage belt engaging the first and second sprocket for-rotation together.

36. The apparatus recited in claim 33 further comprising means for changing the angular relationship of the straight line of exercise for each arm assembly relative to the back rest.

37. The apparatus recited in claim 33 further comprising means for changing the angular relationship of the straight line of exercise for each leg assembly relative to the seat.

* * * * *